US011270639B2

(12) United States Patent
Yamamoto

(10) Patent No.: US 11,270,639 B2
(45) Date of Patent: Mar. 8, 2022

(54) PIXEL CIRCUIT AND DISPLAY DEVICE

(71) Applicant: JOLED INC., Tokyo (JP)

(72) Inventor: Tetsuro Yamamoto, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 17/006,023

(22) Filed: Aug. 28, 2020

(65) Prior Publication Data

US 2021/0125556 A1 Apr. 29, 2021

(30) Foreign Application Priority Data

Oct. 28, 2019 (JP) ..... JP2019-194927

(51) Int. Cl.
*G09G 3/3233* (2016.01)

(52) U.S. Cl.
CPC ... *G09G 3/3233* (2013.01); *G09G 2300/0452* (2013.01); *G09G 2310/0286* (2013.01); *G09G 2310/08* (2013.01); *G09G 2320/0233* (2013.01); *G09G 2320/0252* (2013.01)

(58) Field of Classification Search
None
See application file for complete search history.

(56) References Cited

U.S. PATENT DOCUMENTS 8,405,583 B2 * 3/2013 Ebisuno ..... G09G 3/325 345/76
2009/0153448 A1 6/2009 Tomida et al.
2010/0053041 A1 * 3/2010 Abe ..... G09G 3/325 345/76
2011/0266542 A1 * 11/2011 Ryu ..... H01L 27/124 257/57
2012/0249510 A1 10/2012 Jankovic et al.
2012/0313923 A1 * 12/2012 Minami ..... G09G 3/3233 345/212

(Continued)

FOREIGN PATENT DOCUMENTS

JP 2009-145594 A 7/2009
JP 2011-248302 A 12/2011

(Continued)

OTHER PUBLICATIONS

Extended European Search Report, dated Feb. 4, 2021, for the corresponding European Patent Application No. 20193908.9.

*Primary Examiner* — Dorothy Harris
(74) *Attorney, Agent, or Firm* — Greenblum & Bernstein, P.L.C.

(57) ABSTRACT

A pixel circuit configured to emit light based on an image signal includes: a light emitting element (organic EL element); a driver transistor configured to adjust current supplied to the light emitting element; and a write transistor connected between a signal line to which the image signal is applied and the driver transistor. The driver transistor includes: a gate electrode; a counter electrode disposed opposite the gate electrode; and a channel disposed between the gate electrode and the counter electrode. A potential applied to the counter electrode in a write period in which the write transistor conducts current in a state in which the image signal is applied to the signal line reduces a resistance value of the driver transistor to lower value than a potential applied to the counter electrode in an emission period of the light emitting element does.

2 Claims, 30 Drawing Sheets

(56) References Cited

U.S. PATENT DOCUMENTS

| | | | | |
|---|---|---|---|---|
| 2013/0063413 | A1* | 3/2013 | Miyake | G09G 3/3233 345/212 |
| 2016/0042694 | A1* | 2/2016 | Lim | G09G 3/3233 345/78 |
| 2017/0249901 | A1 | 8/2017 | Nakamura | |
| 2019/0279564 | A1 | 9/2019 | Kim et al. | |

FOREIGN PATENT DOCUMENTS

| | | | |
|---|---|---|---|
| JP | 2013-057947 | A | 3/2013 |
| JP | 2013-076994 | A | 4/2013 |
| JP | 2017-151300 | A | 8/2017 |

* cited by examiner

PIXEL CIRCUIT AND DISPLAY DEVICE

CROSS REFERENCE TO RELATED APPLICATION

The present application is based on and claims priority of Japanese Patent Application No. 2019-194927 filed on Oct. 28, 2019. The entire disclosure of the above-identified application, including the specification, drawings and claims is incorporated herein by reference in its entirety.

FIELD

The present disclosure relates to a pixel circuit and a display device.

BACKGROUND

One example of known electro-optic elements used in emissive display devices is organic electroluminescent (EL) elements. Organic EL elements are electro-optic elements that make use of the phenomenon that light is emitted when an electrical field is applied to an organic thin film, and color gradation is achieved by controlling the value of the current flowing through the organic EL element. Accordingly, in display devices that use organic EL elements, each pixel is provided with a pixel circuit including a driver transistor for controlling the amount of current flowing through the organic EL element, and a storage capacitor that stores the control voltage of the driver transistor.

Variations in characteristics between driver transistors affect the luminance of the light emitted by the organic EL elements. Specific examples of variations in characteristics between driver transistors include variations in threshold voltage and variations in mobility. In view of this, Patent Literature (PTL) 1 discloses a display device that performs threshold voltage correction, which corrects variations in threshold voltage between driver transistors, and mobility correction, which corrects variations in mobility between driver transistors.

CITATION LIST

Patent Literature

PTL 1: Japanese Unexamined Patent Application Publication No. 2013-057947

SUMMARY

Technical Problem

Recent years have seen larger display devices and display devices with higher aperture ratios. Increasing the size or aperture ratio of a display device also increases the surface area of the organic EL elements included in the pixel circuits. This consequently increases the capacitance of the organic EL element. An increase in the capacitance of the organic EL element results in an increase in the time required to correct mobility. Accordingly, the display device according to PTL 1 has a technical problem in that the time required to correct mobility increases when the size or aperture ratio of the display device is increased.

The present disclosure was conceived in view of this problem, and has an object to provide a pixel circuit and a display device that increases the speed of mobility correction.

Solution to Problem

In order to achieve the above-described object, a pixel circuit according to one aspect of the present disclosure is configured to emit light based on an image signal, and includes: a light emitting element; a driver transistor configured to adjust current supplied to the light emitting element; and a write transistor connected between a signal line to which the image signal is applied and the driver transistor. The driver transistor includes: a gate electrode; a counter electrode disposed opposite the gate electrode; and a channel disposed between the gate electrode and the counter electrode. A potential applied to the counter electrode in a write period in which the write transistor conducts current in a state in which the image signal is applied to the signal line reduces a resistance value of the driver transistor to a lower value than a potential applied to the counter electrode in an emission period of the light emitting element does.

In order to achieve the above-described object, a display device according to one aspect of the present disclosure includes: the pixel circuit described above; a horizontal selector configured to apply the image signal to the signal line; a write scanner configured to control the write transistor; and a power supply scanner configured to apply a potential to a source electrode or a drain electrode of the driver transistor.

Advantageous Effects

According to one aspect of the present disclosure, the pixel circuit, etc., can increase the speed of mobility correction.

BRIEF DESCRIPTION OF DRAWINGS

These and other advantages and features will become apparent from the following description thereof taken in conjunction with the accompanying Drawings, by way of non-limiting examples of embodiments disclosed herein.

DESCRIPTION OF EMBODIMENTS

Underlying Knowledge Forming Basis of the Present Disclosure

Before describing each of the embodiments according to the present disclosure, the underlying knowledge forming the basis of the present disclosure will be described.

Figure 1:
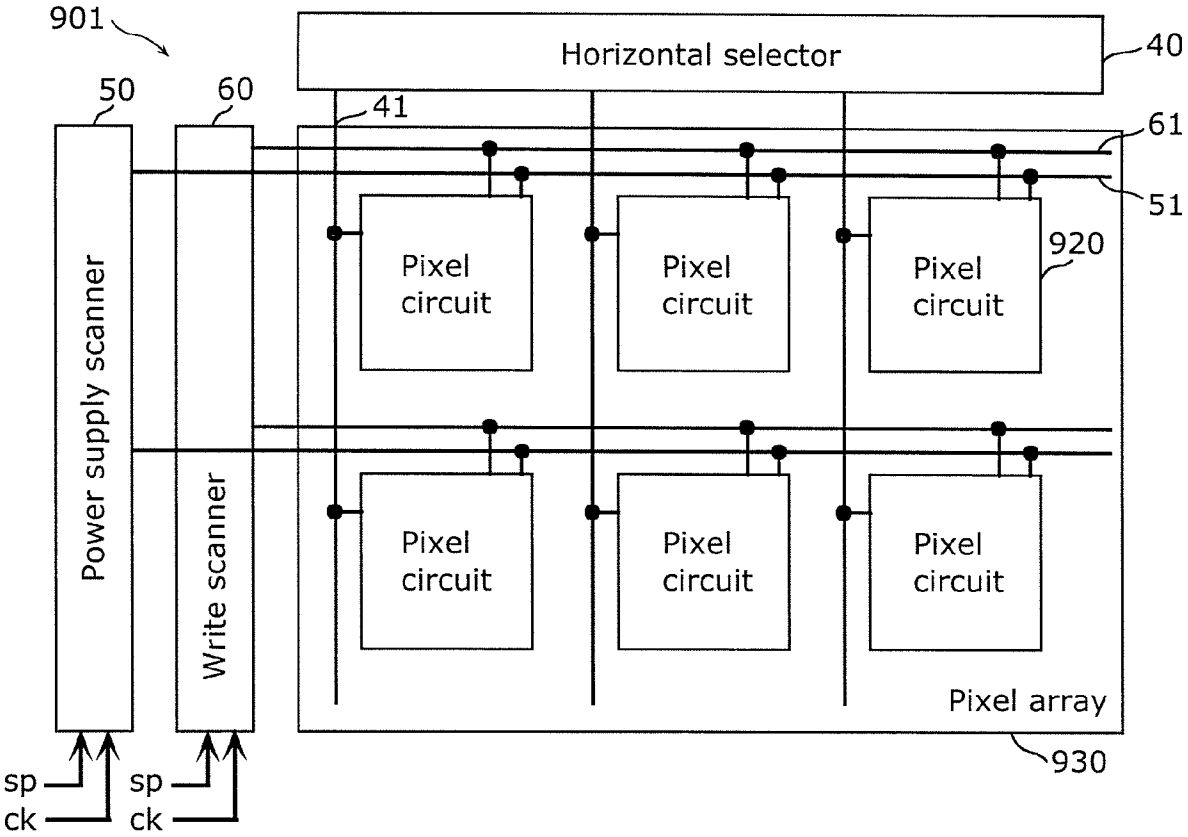
FIG. 1 PRIOR ART
FIG. 1 illustrates a schematic configuration of a conventional display device.

First, a schematic configuration of a conventional display device will be described with reference to FIG. 1. FIG. 1 illustrates a schematic configuration of a conventional display device 901.

As illustrated in FIG. 1, display device 901 on which the present disclosure is premised includes pixel array 930, horizontal selector 40, power supply scanner 50, and write scanner 60. Pixel array 930 is comprised of pixel circuits 920 arranged in a two-dimensional matrix. Each pixel circuit 920 includes an organic EL element. Horizontal selector 40, power supply scanner 50, and write scanner 60 collectively form a drive circuit unit (drive unit) disposed in the vicinity of pixel array 930.

When display device 901 supports color display, one pixel (unit pixel), which corresponds to a unit of information that makes up a color image, is comprised of a plurality of subpixel circuits. Each of these subpixel circuits corresponds to pixel circuit 920 illustrated in FIG. 1. More specifically, in display device 901, which supports color display, one pixel is comprised of, for example, three subpixel circuits, namely a first subpixel circuit that emits blue (B) light, a second subpixel circuit that emits red (R) light, and a third subpixel circuit that emits green (G) light. Blue light is one example of first color light, red light is one example of light of second color light, and green light is one example of third color light.

However, one pixel is not limited to a combination of three subpixel circuits corresponding to the RGB colors; one pixel may additionally include one or more subpixel circuits corresponding to one or more colors. For example, one pixel may additionally include a subpixel circuit that emits white (W) color for improving luminance, and one pixel may additionally include one or more subpixel circuits that emit complementary color light for a wider color reproduction range.

Moreover, each pixel row in pixel array 930 is provided with power supply line 51 and scan line 61 that extend parallel to the row direction (the direction in which pixel circuits 920 are arranged in a single pixel row) relative to the m rows and n columns of pixels. Furthermore, each pixel column in pixel array 930 is provided with signal line 41 that extends parallel to the column direction (the direction in which pixel circuits 920 are arranged in a single pixel column) relative to the m rows and n columns of pixel circuits 920.

Each signal line 41 is connected to the output terminal of the corresponding pixel column of horizontal selector 40. Each power supply line 51 is connected to the output terminal of the corresponding pixel row of power supply scanner 50. Each scan line 61 is connected to the output terminal of the corresponding pixel row of write scanner 60.

Horizontal selector 40 (signal line drive circuit) selectively outputs signal voltage Vsig (hereinafter also simply referred to as "signal voltage") of an image signal and reference potential Vofs. Signal voltage Vsig is dependent on luminance information supplied from a signal supply source (not illustrated in the drawings). Here, reference potential Vofs is a voltage that serves as a reference for signal voltage Vsig of an image signal (for example, a voltage corresponding to a black level of an image signal), and is used when performing a threshold correction operation, which will be described later.

Signal voltage Vsig and reference potential Vofs output from horizontal selector 40 are written to pixel circuits 920 in pixel array 930 via signal line 41 on a row-by-row basis for pixel rows selected via scanning by write scanner 60. In other words, horizontal selector 40 employs a line sequential writing driving mode in which signal voltage Vsig is written on a row-by-row (line-by-line) basis.

Power supply scanner 50 (power supply scan circuit) is configured of, for example, a shift register circuit that sequentially shifts start pulses sp in synchronization with clock pulse ck. Power supply scanner 50 switches between supplying first potential Vcc and supplying second potential Vss, which is lower than first potential Vcc, to power supply line 51, in synchronization with the line sequential scanning by write scanner 60. As will be described later, this switching between first potential Vcc and second potential Vss (switching between power supply potentials) controls the light emission and non-emission states of pixel circuits 920.

Write scanner 60 (write scan circuit) is configured of, for example, a shift register circuit that sequentially shifts (transfers) start pulses sp in synchronization with clock pulse ck. When writing a signal voltage of an image signal to each pixel circuit 920 of pixel array 930, write scanner 60 sequentially supplies write scan signals (which are write voltages; hereinafter also referred to as ON signals) to scan lines 61, thereby scanning (line sequential scanning) pixel circuits 920 of pixel array 930 in succession on a row-by-row basis.

Figure 2:
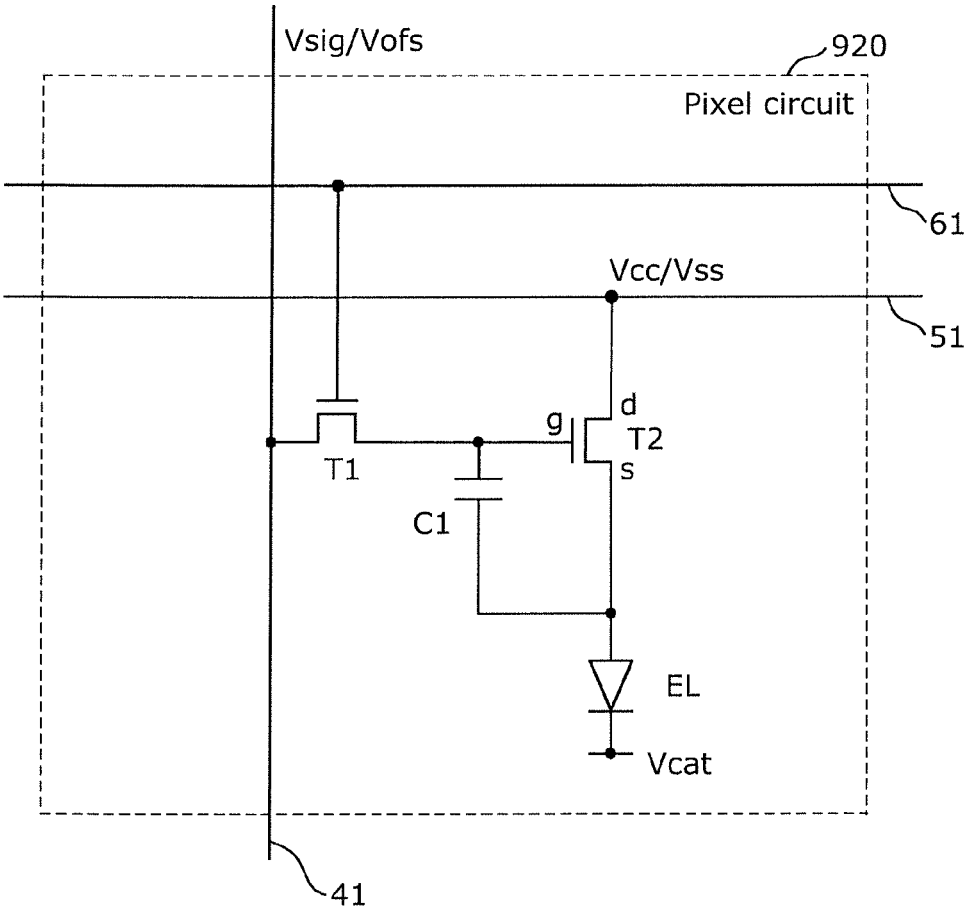
FIG. 2 PRIOR ART
FIG. 2 illustrates a circuit diagram of a conventional pixel circuit.

Next, pixel circuits 920 included in display device 901 configured as described above will be described with reference to FIG. 2. FIG. 2 illustrates a circuit diagram of a conventional pixel circuit 920.

As illustrated in FIG. 2, pixel circuit 920 is a circuit that causes organic EL element EL to emit light at a luminance that corresponds to the image signal, and includes organic EL element EL, storage capacitor C1, write transistor T1, and driver transistor T2. Pixel circuit 920 may further include, for example, a reference transistor and an initialization transistor. The reference transistor is a thin film transistor for applying a reference voltage to storage capacitor C1, and the initialization transistor is a thin film transistor for initializing the potential of a first electrode of organic EL element EL.

Organic EL element EL is a light emitting element including a first electrode and a second electrode. In the example illustrated in FIG. 2, the first electrode and the second electrode are respectively the anode and the cathode of organic EL element EL. The second electrode of organic EL element EL is connected to a cathode power supply line. The cathode power supply line is supplied with cathode potential Vcat. Organic EL element EL is one example of the light emitting element. The cathode power supply line is wired commonly to all pixel circuits 920.

Storage capacitor C1 is an element for storing voltage, and is connected between gate electrode g and source electrode s of driver transistor T2.

Write transistor T1 is a thin film transistor for applying voltage that corresponds to the image signal to storage capacitor C1. Signal line 41 is connected to one of the drain electrode and the source electrode of write transistor T1, and storage capacitor C1 and gate electrode g of driver transistor T2 are connected to the other of the drain electrode and the source electrode of write transistor T1. Scan line 61 is connected to the gate electrode of write transistor T1. For example, write transistor T1 enters an ON state in accordance with an ON signal, and stores voltage corresponding to the image signal in storage capacitor C1.

Driver transistor T2 is a thin film transistor that is connected to the first electrode (anode) of organic EL element EL and supplies current dependent on the voltage stored in storage capacitor C1 to organic EL element EL. Source electrode s of driver transistor T2 is connected to the first electrode of organic EL element EL, and drain electrode d is connected to power supply line 51. First potential Vcc or second potential Vss is selectively supplied to power supply line 51 from power supply scanner 50.

For example, N-channel thin film transistors (TFT) can be used as write transistor T1 and driver transistor T2, but the conductivity types of write transistor T1 and driver transistor T2 are not limited to this combination example.

Moreover, depending on the relationship between the potential of the first electrode of organic EL element EL and the potential supplied from power supply line 51, the positional relationship of source electrode s and drain electrode d in driver transistor T2 can be changed from the relationship illustrated in FIG. 2.

In pixel circuit 920 configured as described above, write transistor T1 enters a conducting state in accordance with an ON signal applied to the gate electrode from write scanner 60 via scan line 61. With this, write transistor T1 samples and writes, into pixel circuit 920, signal voltage Vsig or reference potential Vofs supplied from horizontal selector 40 via signal line 41. Signal voltage Vsig or reference potential Vofs written by write transistor T1 is applied to gate electrode g of driver transistor T2 and stored in storage capacitor C1.

When the power supply potential from power supply line 51 is first potential Vcc, the power supply line 51 side becomes drain electrode d and the organic EL element EL side becomes source electrode s, whereby driver transistor T2 operates in a saturation region, as illustrated in FIG. 2. With this, driver transistor T2 receives a supply of current from power supply line 51 and drives organic EL element EL so as to emit light via current driving. More specifically, as a result of driver transistor T2 operating in a saturation region, driver transistor T2 supplies a drive current, whose current value is dependent on the voltage value of signal voltage Vsig stored in storage capacitor C1, to organic EL element EL, and causes organic EL element EL to emit light by current driving organic EL element EL.

Furthermore, when the power supply potential from power supply line 51 is switched from first potential Vcc to second potential Vss, the power supply line 51 side becomes source electrode s and the organic EL element EL side becomes drain electrode d, whereby driver transistor T2 operates as a switching transistor. With this, driver transistor T2 interrupts the supply of drive current to organic EL element EL, thereby placing organic EL element EL in a light non-emission state. In other words, driver transistor T2 can function as a transistor that controls the light emission and non-emission states of organic EL element EL.

By providing a period in which organic EL element EL is in a light non-emission state (hereinafter also referred to as a non-emission period) via this switching operation performed by driver transistor T2, it is possible to control the duty of the emission period and the non-emission period of organic EL element EL. This duty control makes it possible to reduce the afterimage effect resulting from pixel circuits 920 emitting light across a period of one frame, which in turn makes it possible to improve video quality.

Among first potential Vcc and second potential Vss that are selectively supplied from power supply scanner 50 via power supply line 51, first potential Vcc is a power supply potential for supplying, to driver transistor T2, drive current that drives organic EL element EL so as to emit light, and second potential Vss is a power supply potential for applying a negative bias (reverse bias) to organic EL element EL. Second potential Vss is set lower than reference potential Vofs. For example, when the threshold voltage of driver transistor T2 is set to Vth, second potential Vss is set lower than Vofs−Vth.

Figure 3:
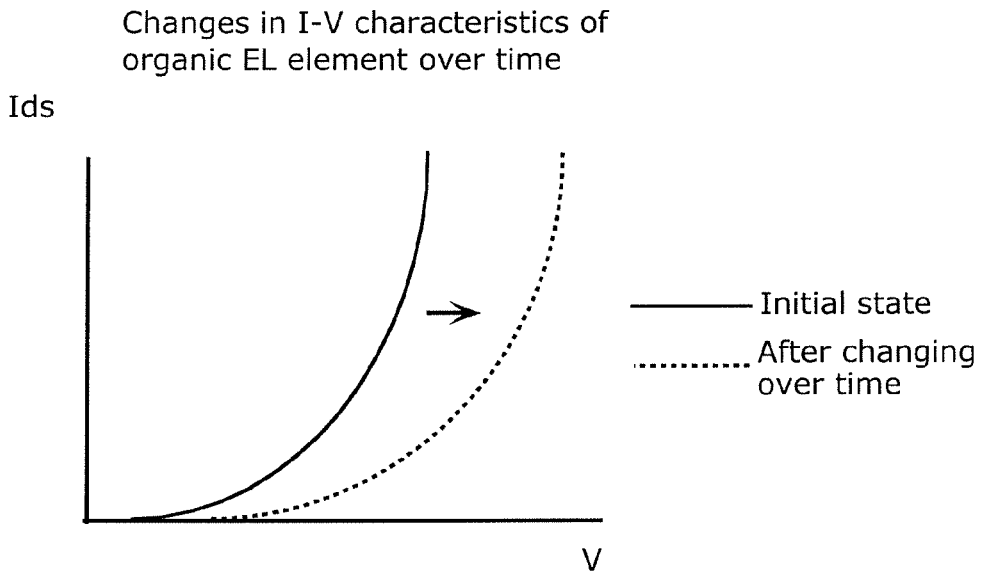
FIG. 3 illustrates changes in the I-V characteristics of an organic EL element over time.

Next, changes in the I-V characteristics (current-voltage characteristics) of organic EL element EL over time will be described with reference to FIG. 3. FIG. 3 illustrates changes in the I-V characteristics of organic EL element EL over time.

As illustrated in FIG. 3, the I-V characteristics of organic EL element EL change over time from the I-V characteristics indicated by the solid line to the I-V characteristics indicated by the dotted line. Drain-source current Ids is expressed as $Ids=\frac{1}{2}\times\mu\times W/L\times C(Vgs-Vth)^2$ (Expression 1), where Vth is the threshold voltage, μ is the mobility, W is the effective channel width (effective gate width), L is the effective channel length (effective gate length), C is the gate capacitance per unit area, and Vgs is the gate-source voltage of driver transistor T2. Note that drain-source current Ids of driver transistor T2 approximately corresponds to the drive current of organic EL element EL. Hereinafter, for convenience, an example in which drain-source current Ids corresponds to the drive current of organic EL element EL will be given. Moreover, the drive current is also referred to as drive current Ids.

At this time, in pixel circuit 920 illustrated in FIG. 2, even if driver transistor T2 attempts to pass a constant drain current Ids, since applied voltage V of organic EL element EL increases, as shown by the graph illustrated in FIG. 3, the potential of the first electrode (anode) of organic EL element EL (that is, source potential Vs of driver transistor T2) increases. At this time, since the gate of driver transistor T2 is in a floating state, the source potential and the gate potential both increase and drain current Ids is maintained at an approximately constant value, so as to maintain gate-source voltage Vgs at an approximately constant value. This works to prevent the luminance of organic EL element EL from changing.

However, since threshold voltage Vth and mobility μ of driver transistor T2 vary from pixel circuit 920 to pixel circuit 920, this results in variations in current values according to Expression 1, whereby the luminance varies from pixel circuit 920 to pixel circuit 920. Accordingly, in pixel circuit 920 which includes driver transistor T2, correction operations for correcting threshold voltage Vth and mobility μ are required for reducing variations in threshold voltage Vth and mobility μ. These correction operations will be described later.

Figure 4:
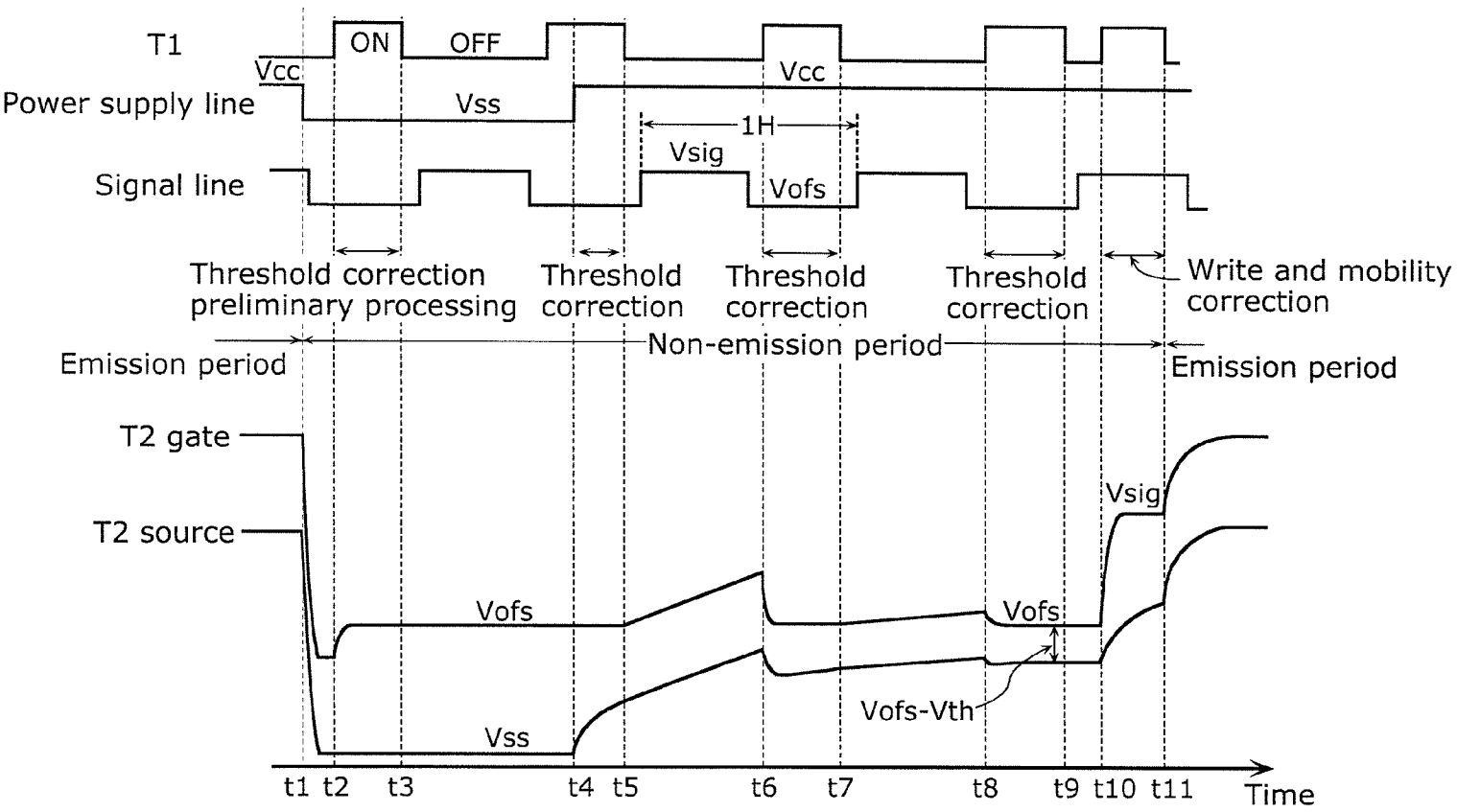
FIG. 4 PRIOR ART
FIG. 4 is a timing chart for describing circuit operations performed by the conventional display device.

Next, the basic circuit operations performed by display device 901 described above will be described with reference to FIG. 4 through FIG. 14. FIG. 4 is a timing chart for describing circuit operations performed by the conventional display device 901. FIG. 4 illustrates changes in the potential of the gate electrode of write transistor T1 (i.e., the potential of scan line 61; either a high potential (ON) or low potential (OFF)), the potential (Vcc or Vss) of power supply line 51, the potential (Vsig or Vofs) of signal line 41, the potential of gate electrode g of driver transistor T2 ("T2 gate" in FIG. 4), and the potential of source electrode s of driver transistor T2 ("T2 source" in FIG. 4).

Emission Period of Previous Display Frame

In the timing chart illustrated in FIG. 4, the period before time t1 is the emission period of organic EL element EL in the previous display frame. In the emission period of the previous display frame, the potential of power supply line 51 is first potential Vcc (hereinafter also referred to as high potential Vcc), and write transistor T1 is in a non-conducting state.

Figure 5:
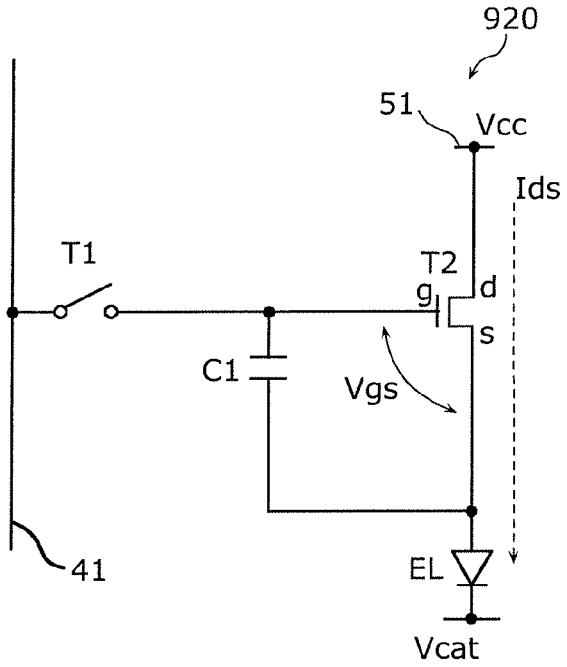
FIG. 5 PRIOR ART
FIG. 5 is a first figure for describing circuit operations performed by the conventional display device.

At this time, driver transistor T2 is set so as to operate in the saturation region. Consequently, as illustrated in FIG. 5, drive current Ids (drain-source current) dependent on gate-source voltage Vgs of driver transistor T2 is supplied from power supply line 51 to organic EL element EL via driver transistor T2. Accordingly, organic EL element EL emits light of a luminance that is in accordance with the current value of drive current Ids. Note that FIG. 5 is a first figure for describing circuit operations performed by the conventional display device 901. Moreover, drive current Ids flowing through organic EL element EL at this time takes a value that is dependent on gate-source voltage Vgs of driver transistor T2 and is calculated by Expression 1.

Non-Emission Period

Figure 6:
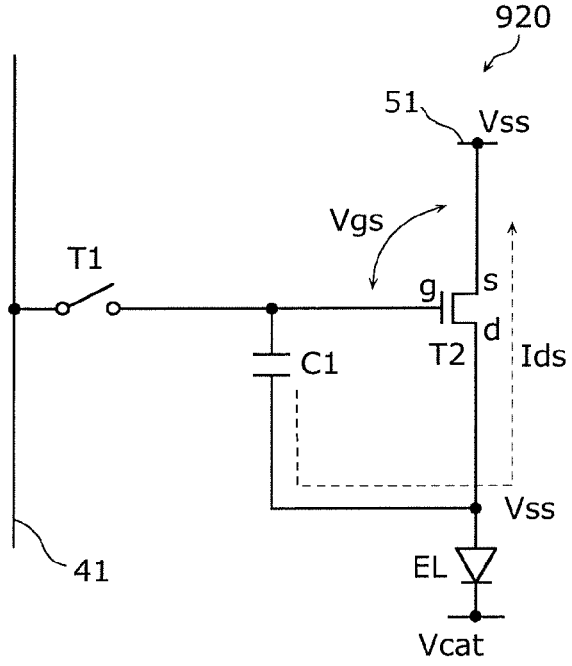
FIG. 6 PRIOR ART
FIG. 6 is a second figure for describing circuit operations performed by the conventional display device.

At time t1, the line sequential scanning enters a new display frame (current display frame). Then, as illustrated in FIG. 6, the potential of power supply line 51 switches from high potential Vcc to second potential Vss (hereinafter also referred to as low potential Vss). Relative to reference potential Vofs of signal line 41, low potential Vss is a potential that is sufficiently lower than Vofs−Vth, and is capable of causing organic EL element EL to not emit light. Note that FIG. 6 is a second figure for describing circuit operations performed by the conventional display device 901.

Here, when low potential Vss satisfies Vss<Vthel+Vcat (Expression 2), where Vthel is the threshold voltage and Vcat is the cathode potential of organic EL element EL, since source potential Vs of driver transistor T2 is approximately equal to low potential Vss, organic EL element EL enters a reverse bias state, and stops emitting light. Then, the power supply line 51 side of driver transistor T2 becomes source electrode s. At this time, the first electrode (anode) of organic EL element EL is charged by Vss.

Threshold Correction Preliminary Period

Figure 7:
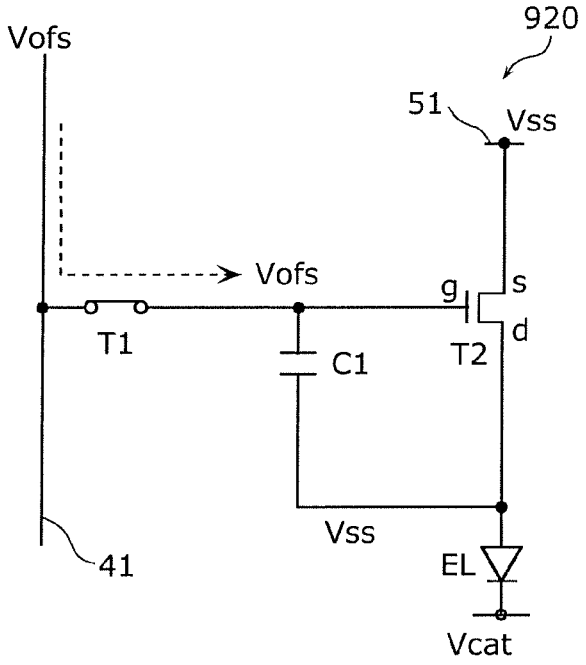
FIG. 7 PRIOR ART
FIG. 7 is a third figure for describing circuit operations performed by the conventional display device.

Next, the potential of scan line 61 transitioning from the low potential side to the high potential side (i.e., from OFF to ON) at time t2 places write transistor T1 in a conducting state, as illustrated in FIG. 7. FIG. 7 is a third figure for describing circuit operations performed by the conventional display device 901.

At this time, since reference potential Vofs is supplied from horizontal selector 40 to signal line 41, gate potential Vg of driver transistor T2 becomes reference potential Vofs. Moreover, source potential Vs of driver transistor T2 is a potential that is sufficiently lower than reference potential Vofs, that is to say, is low potential Vss.

At this time, gate-source voltage Vgs of driver transistor T2 is Vofs−Vss. Here, if Vofs−Vss is not greater than threshold voltage Vth of driver transistor T2, the threshold correction operation (to be described later) cannot be performed, so it is necessary to set Vofs−Vss so as to satisfy the potential relation Vofs−Vss>Vth (Expression 3).

In this way, initialization processing that fixes gate potential Vg of driver transistor T2 to reference potential Vofs and fixes source potential Vs to low potential Vss is preliminary processing performed before threshold correction operation (to be described later) (i.e., is threshold correction preliminary processing). Accordingly, reference potential Vofs and low potential Vss are the initialization potentials of gate potential Vg and source potential Vs of driver transistor T2, respectively.

The potential of scan line 61 transitioning from the high potential side to the low potential side (i.e., from ON to OFF) at time t3 ends the threshold correction preliminary period. The period from time t2 to time t3 is a threshold correction preliminary period.

Threshold Correction Period

Figure 8:
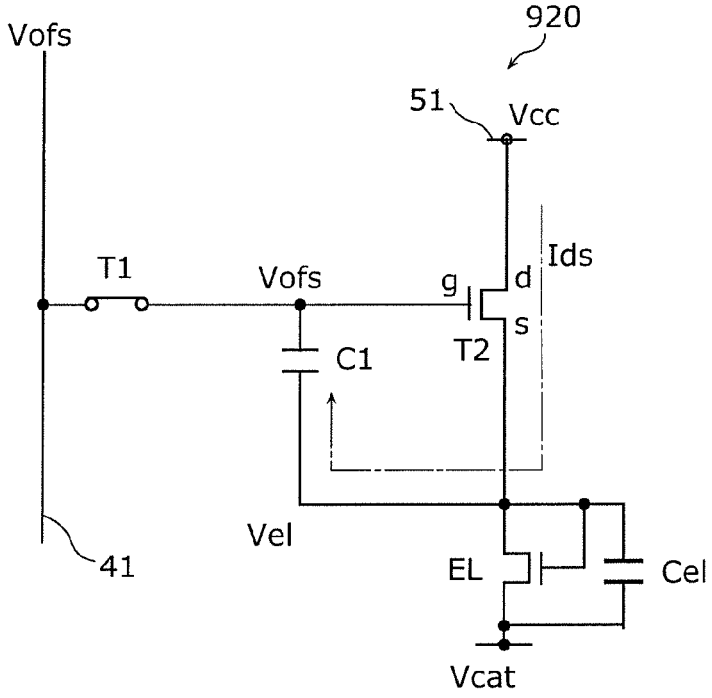
FIG. 8 PRIOR ART
FIG. 8 is a fourth figure for describing circuit operations performed by the conventional display device.

Next, at time t4, when the potential of power supply line 51 switches from low potential Vss to high potential Vcc while write transistor T1 is in a conducting state, the first electrode of organic EL element EL becomes the source electrode s of driver transistor T2, as illustrated in FIG. 8, and current flows to driver transistor T2. Consequently, the threshold correction operation starts in a state in which gate potential Vg of driver transistor T2 is maintained at reference potential Vofs. In other words, source potential Vs of driver transistor T2 begins to increase from gate potential Vg toward a potential calculated by subtracting threshold voltage Vth of driver transistor T2 (i.e., Vofs−Vth). Note that FIG. 8 is a fourth figure for describing circuit operations performed by the conventional display device 901.

Here, for convenience, using reference potential Vofs (i.e., the initialization voltage) of gate potential Vg of driver transistor T2 as a reference, the operation (process) for causing source potential Vs to change from reference potential Vofs toward a voltage calculated by subtracting threshold voltage Vth of driver transistor T2, will be referred to as a threshold correction operation (threshold correction processing). As this threshold correction operation progresses, in time, gate-source voltage Vgs of driver transistor T2 converges to threshold voltage Vth of driver transistor T2. A voltage corresponding to this threshold voltage Vth is stored in storage capacitor C1.

Note that in the periods in which a threshold correction operation is performed (the threshold correction periods in FIG. 4), in order to cause current to flow to the storage capacitor C1 side and not to flow to the organic EL element EL side, cathode potential Vcat of the power supply cathode power supply line is set so as to place organic EL element EL in a cut-off state (high-impedance state).

An equivalent circuit of organic EL element EL is expressed as a diode and equivalent capacitor Cel, as illustrated in FIG. 8. So long as the relation Vel≤Vcat+Vthel (Expression 4) holds true, where Vel is the source potential of driver transistor T2, the current of driver transistor T2 is used for charging storage capacitor C1 and equivalent capacitor Cel. For example, so long as the leak current of organic EL element EL is substantially smaller than the current flowing through driver transistor T2, the current of driver transistor T2 is used for charging storage capacitor C1 and equivalent capacitor Cel. Note that source potential Vel is also the potential of the first electrode of organic EL element EL.

Figure 9:
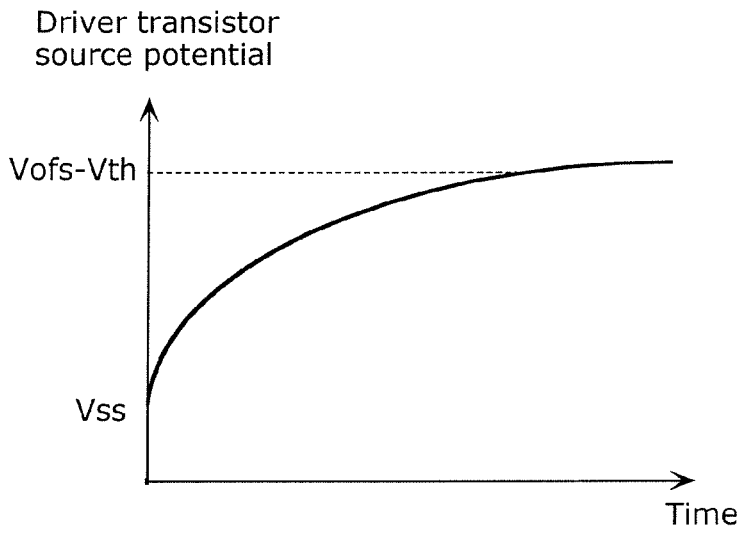
FIG. 9 PRIOR ART
FIG. 9 is a first figure illustrating changes in source potential of the driver transistor in the conventional display device.

Next, changes in source potential Vel will be described with reference to FIG. 9. FIG. 9 is a first figure illustrating changes in source potential Vel of driver transistor T2 in the conventional display device 901. FIG. 9 schematically illustrates changes in source potential Vel under a threshold correction operation.

As illustrated in FIG. 9, source potential Vel increases over time. Source potential Vel gradually increases from Vss toward Vofs−Vth.

Figure 10:
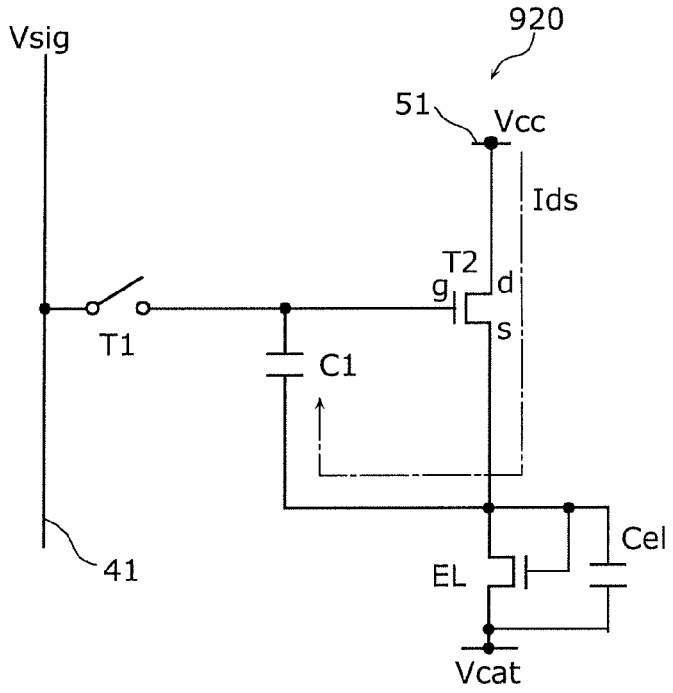
FIG. 10 PRIOR ART
FIG. 10 is a fifth figure for describing circuit operations performed by the conventional display device.

Next, at time t5, the potential of scan line 61 transitioning to the low potential side (i.e., from ON to OFF) places write transistor T1 in a non-conducting state. Write transistor T1 enters a non-conducting state at time t5, which is a point in time after elapse of a first period after time t4. At this time, gate electrode g of driver transistor T2 is in a floating state as a result of electrically disconnecting from signal line 41. However, since gate-source voltage Vgs is greater than threshold voltage Vth of driver transistor T2, current (drain current Ids) flows, and the gate and source potentials of driver transistor T2 increase, as illustrated in FIG. 10. Note that since a reverse bias is applied to organic EL element EL at this time, organic EL element EL does not emit light. Note that FIG. 10 is a fifth figure for describing circuit operations performed by the conventional display device 901.

Next, at time t6, in the period in which the potential of signal line 41 is reference potential Vofs (for example, at the point in time the potential of signal line 41 becomes reference potential Vofs), write transistor T1 is placed in a conducting state, and threshold correction operation is started once again. By repeating this operation, the value of gate-source voltage Vgs of driver transistor T2 eventually becomes threshold voltage Vth. Here, source potential Vel of driver transistor T2 is expressed as Vel=Vofs−Vth≤cat+Vthel (Expression 5).

Next, at time t7, the potential of scan line 61 transitioning to the low potential side (i.e., from ON to OFF) places write transistor T1 in a non-conducting state. Write transistor T1 enters a non-conducting state at time t7, which is a point in time after elapse of a second period after time t6.

Moreover, the threshold correction operation is repeated in the period between time t8 and time t9 as well. Time t9 is the time at which the threshold correction operation ends, and write transistor T1 enters a non-conducting state at time t9. The period from time t4 to time t5, the period from time t6 to time t7, and the period from time t8 to time t9 are threshold correction periods.

In this way, in addition to the 1H period in which display device 901 performs the threshold correction operation along with the write operation and the mobility correction operation, display device 901 may perform the threshold correction operation multiple times divided across a plurality of horizontal periods ahead of the 1H period, that is to say, perform a "divided threshold correction operation".

With this divided threshold correction operation, even if the time allotted as a single horizontal period is short due to an increase in the number of pixels to achieve a higher definition, sufficient time can be ensured across a plurality of horizontal periods functioning as the threshold correction period. Accordingly, since a sufficient amount of time for a threshold correction period can be ensured even if the time allotted to a single horizontal period is short, it is possible to perform the threshold correction operation with certainty. Note that the number of times the threshold correction operation is performed is not limited to the above example; for example, the threshold correction operation may be performed only one time.

Write and Mobility Correction Period

Figure 11:
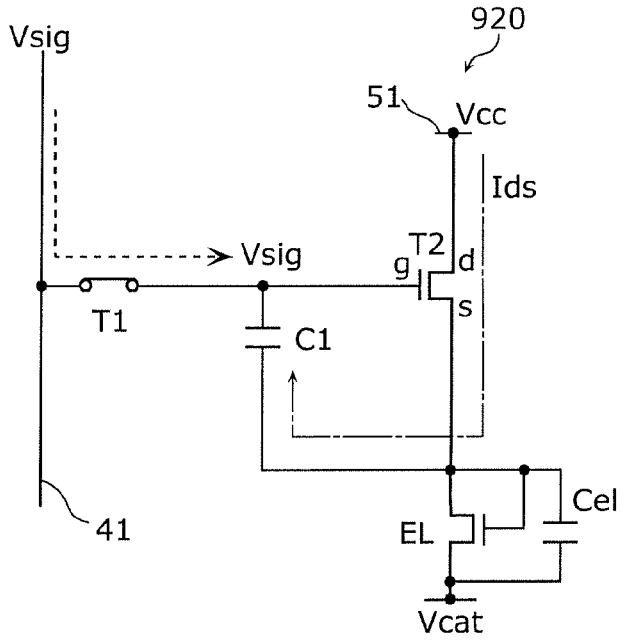
FIG. 11 PRIOR ART
FIG. 11 is a sixth figure for describing circuit operations performed by the conventional display device.

Next, at time t10, in a state in which the potential of signal line 41 has switched from reference potential Vofs to signal voltage Vsig of the image signal, the potential of scan line 61 transitioning to the high potential side (i.e., from OFF to ON) places write transistor T1 in a conducting state, whereby signal voltage Vsig of the image signal is sampled and written in pixel circuit 920, as illustrated in FIG. 11. Note that FIG. 11 is a sixth figure for describing circuit operations performed by the conventional display device 901. Moreover, signal voltage Vsig is a voltage that is dependent on the gradation of the image signal.

The writing of signal voltage Vsig by write transistor T1 turns gate potential Vg of driver transistor T2 into signal voltage Vsig. At this time, organic EL element EL is in a cut-off state. Accordingly, depending on signal voltage Vsig of the image signal, the current flowing through driver transistor T2 (drain-source current Ids) from power supply line 51 flows into storage capacitor C1 and equivalent capacitor Cel. This starts the charging of storage capacitor C1 and equivalent capacitor Cel.

For example, if source potential Vs of driver transistor T2 does not exceed the sum of threshold voltage Vthel and cathode potential Vcat of organic EL element EL, the current for driver transistor T2 is used for charging storage capacitor C1 and equivalent capacitor Cel.

The charging of equivalent capacitor Cel of organic EL element EL causes source potential Vs of driver transistor T2 to increase over time. At this time, variations in threshold voltage Vth of driver transistor T2 between pixel circuits 920 are already cancelled by the threshold correction operation, and drain-source current Ids of driver transistor T2 is dependent on mobility μ of driver transistor T2 (see Expression 1). With this, reflecting mobility μ, the value of gate-source voltage Vgs of driver transistor T2 decreases, and after elapse of a given period of time, becomes a value that completely corrects mobility μ. Note that mobility μ of driver transistor T2 is the mobility of the semiconductor thin film that forms the channel of driver transistor T2.

Figure 12:
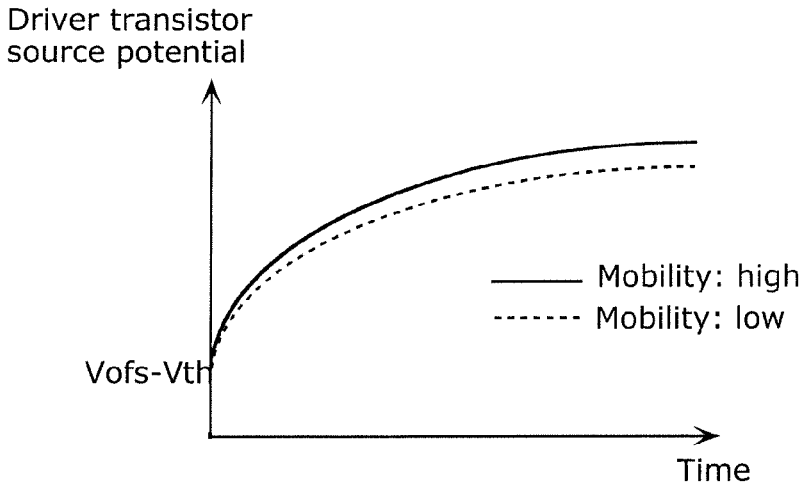
FIG. 12 PRIOR ART
FIG. 12 is a second figure illustrating the relation between source potential of the driver transistor and mobility in the conventional display device.

FIG. 12 is a second figure illustrating a relationship between source potential Vs of driver transistor T2 and mobility μ in the conventional display device 901. FIG. 12 illustrates changes in source potential caused by variations in mobility μ.

As illustrated in FIG. 12, in pixel circuit 920 that includes driver transistor T2 having a relatively high mobility μ, the amount of current of driver transistor T2 is high, and source potential Vs increases faster than when mobility μ is relatively low. Moreover, in pixel circuit 920 that includes driver transistor T2 having a relatively low mobility μ, the amount of current of driver transistor T2 is low, and source potential Vs increases slower than when mobility μ is relatively high.

For example, consider a case in which, in two pixel circuits 920 whose mobilities μ are different, signal voltage Vsig of the same level is applied to gate electrodes g of driver transistors T2. In this case, if mobility correction is not performed, there will be a significant difference in the values of drain-source current Ids flowing through pixel circuit 920 having a high mobility μ and drain-source current Ids flowing through pixel circuit 920 having a low mobility μ. Consequently, due to the differences in mobilities μ between the two pixel circuits 920, there is a significant difference in the values of drain-source current Ids, which results in a loss of uniformity in the image (for example, a loss of brightness uniformity).

For this reason, mobility correction is performed as described above. Hereinafter, mobility correction will be described in greater detail.

When the ratio of the stored voltage of storage capacitor C1 to signal voltage Vsig of the image signal, i.e., the write gain, is assumed to be one (ideal value), source potential Vs of driver transistor T2 increases from Vofs−Vth by an amount of ΔVs, whereby gate-source voltage Vgs of driver transistor T2 becomes Vsig−Vofs+Vth−ΔVs. ΔVs indicates the amount of potential that source potential Vs is increased by.

In other words, the amount of increase ΔVs of source potential Vs of driver transistor T2 works so as to be subtracted from the voltage stored in storage capacitor C1 (Vsig−Vofs+Vth), or stated differently, works so as to discharge the charge of storage capacitor C1. Stated in yet another way, the amount of increase ΔVs of source potential Vs of driver transistor T2 is negative feedback applied to storage capacitor C1. Accordingly, the amount of increase ΔVs of source potential Vs is an amount of negative feedback.

In this way, as a result of negative feedback being applied to gate-source voltage Vgs by an amount of feedback ΔVs dependent on drain-source current Ids flowing through driver transistor T2, the dependency on mobility μ of drain-source current Ids of driver transistor T2 can be cancelled out. This cancelling operation is a mobility correction operation for correcting variations in mobility μ of driver transistor T2 between pixel circuits 920.

More specifically, when correction via feedback ΔVs is applied to pixel circuit 920 having a high mobility μ, drain-source current Ids significantly drops—from a first current value to a second current value. On the other hand, since feedback ΔVs of a pixel circuit 920 having a low mobility μ is low, drain-source current Ids drops from a third current value (which is less than the first current value) to a fourth current value. Performing mobility correction in a period in which the second current value and the fourth current value are equal corrects variations in mobility μ between pixel circuits 920. The amount of negative feedback ΔVs can also be referred to as a correction amount for the mobility correction operation.

Moreover, since the higher the signal amplitude (Vsig−Vofs) of the image signal written to gate electrode g of driver transistor T2 is, the higher the value of drain-source current Ids is, the absolute value of the amount of negative feedback ΔVs also increases. Accordingly, the mobility correction operation is dependent on the luminance level.

Emission Period

Next, at time t11, the potential of scan line 61 transitioning to the low potential side (i.e., from ON to OFF) places write transistor T1 in a non-conducting state, and the write operation ends. Consequently, gate electrode g of driver transistor T2 is in a floating state as a result of electrically disconnecting from signal line 41. The period from time t10 to time t11 is a write and mobility correction period.

Here, when gate electrode g of driver transistor T2 is in a floating state, by storage capacitor C1 being connected between the gate and source of driver transistor T2, gate potential Vg changes in conjunction with changes in source potential Vs of driver transistor T2. In other words, source potential Vs and gate potential Vg of driver transistor T2 increase while gate-source voltage Vgs stored in storage capacitor C1 is maintained. Source potential Vs of driver transistor T2 increases to a light-emission voltage of organic EL element EL that is dependent on drain-source current Ids (saturation current) of driver transistor T2.

In this way, the operation whereby gate potential Vg of driver transistor T2 changes in conjunction with changes in source potential Vs of driver transistor T2 is a bootstrap operation. Stated differently, a bootstrap operation is an operation whereby gate potential Vg and source potential Vs change while gate-source voltage Vgs stored in storage capacitor C1, i.e., voltage across both terminals of storage capacitor C1 is maintained.

Figure 13:
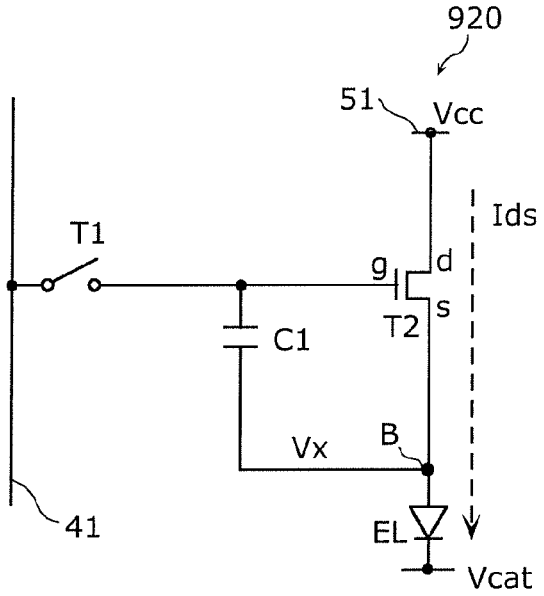
FIG. 13 PRIOR ART
FIG. 13 is a seventh figure for describing circuit operations performed by the conventional display device.

As a result of gate electrode g of driver transistor T2 entering a floating state and at the same time drain-source current Ids of driver transistor T2 starting to flow through organic EL element EL, the potential of the first electrode (anode) of organic EL element EL increases to potential Vx in accordance with drain-source current Ids, as illustrated in FIG. 13. Then, when potential Vx (for example, the potential at point B in FIG. 13) of the first electrode of organic EL element EL exceeds Vthel+Vcat, drive current Ids begins to flow through organic EL element EL, causing organic EL element EL to start emitting light. Note that FIG. 13 is a seventh figure for describing circuit operations performed by the conventional display device 901.

In pixel circuit 920 configured as described above, the longer organic EL element EL emits light, the more the I-V characteristics change (degrade), i.e., the I-V characteristics change (degrade) over time. Accordingly, the potential at point B in FIG. 13 also changes. However, since gate-source voltage Vgs of driver transistor T2 is not maintained at a constant value, the current flowing through organic EL element EL does not change. Accordingly, even if the I-V characteristics of organic EL element EL change, a constant drive current Ids continues to flow through organic EL element EL, and thus the luminance of organic EL element EL does not change.

Next, mobility correction operation in signal writing will be discussed. As described above, a mobility correction operation is an operation for increasing source potential Vs of driver transistor T2 for a given period of time, until source potential Vs (gate-source voltage Vgs) reaches a level that corrects variations in mobility μ of driver transistor T2 in each pixel circuit 920, by causing current to flow through driver transistor T2 after completion of the threshold correction operation. At this time, the increase in source potential Vs of driver transistor T2 is dependent on the current flowing through driver transistor T2 and the capacitor connected to source electrode s of driver transistor T2.

Figure 14:
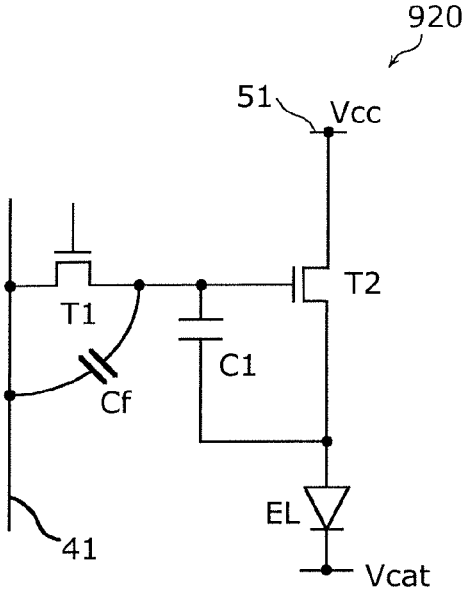
FIG. 14 PRIOR ART
FIG. 14 is an eighth figure for describing circuit operations performed by the conventional display device.

Typically, emission of light by display device 901 is determined by the amount of current flowing through organic EL element EL, which is determined by driver transistor T2. It is preferable to reduce the size (W/L ratio) of driver transistor T2 in pixel circuit 920 in order to reduce the effect of coupling noise generated by parasitic capacitance Cf between gate electrode g of driver transistor T2 and the wire disposed adjacent to driver transistor T2 (for example, signal line 41 in the example in FIG. 14). However, reducing the size of driver transistor T2 also reduces the amount of increase in source potential Vs of driver transistor T2 in the mobility correction operation, thereby increasing the time required to perform mobility correction. Note that FIG. 14 is an eighth figure for describing circuit operations performed by the conventional display device 901.

Moreover, when display device 901 is large, the size of the pixel circuits (pixels) increases, and the surface area of organic EL elements EL increase. This increases the capacitance of equivalent capacitor Cel of organic EL element EL, which increases the time required to perform mobility correction.

Accordingly, it is difficult to perform mobility correction within a predetermined period of time (for example, a 1H period), and abnormalities such as cut-off lines and uneven regions may appear in the image.

In view of this, as a result of diligent research, the inventor of the present application invented a pixel circuit and a display device which can increase the speed of mobility correction (mobility correction operation) in a display device that performs the above-described mobility correction operation. Hereinafter, such a pixel circuit and display device will be described.

Hereinafter, exemplary embodiments of the present disclosure will be described with reference to the drawings. Each of the exemplary embodiments described below is merely one specific example of the present disclosure. The numerical values, shapes, materials, elements, and arrangement and connection of the elements, steps, order of the steps, etc., indicated in the following exemplary embodiments are examples, and are not intended to limit the present disclosure. Therefore, among elements in the following exemplary embodiments, those not recited in any one of the independent claims in the present disclosure are described as optional elements.

Note that the respective figures are schematic diagrams and are not necessarily precise illustrations. Additionally, like reference signs indicate like elements. As such, repeated explanations of like elements are omitted or simplified.

Moreover, in the present specification, stated values and value ranges include essentially equivalent values or value ranges, i.e., include deviations of about a few percent.

Embodiment 1

A pixel circuit and a display device according to Embodiment 1 will be described.

1-1. Display Device Configuration

Figure 15:
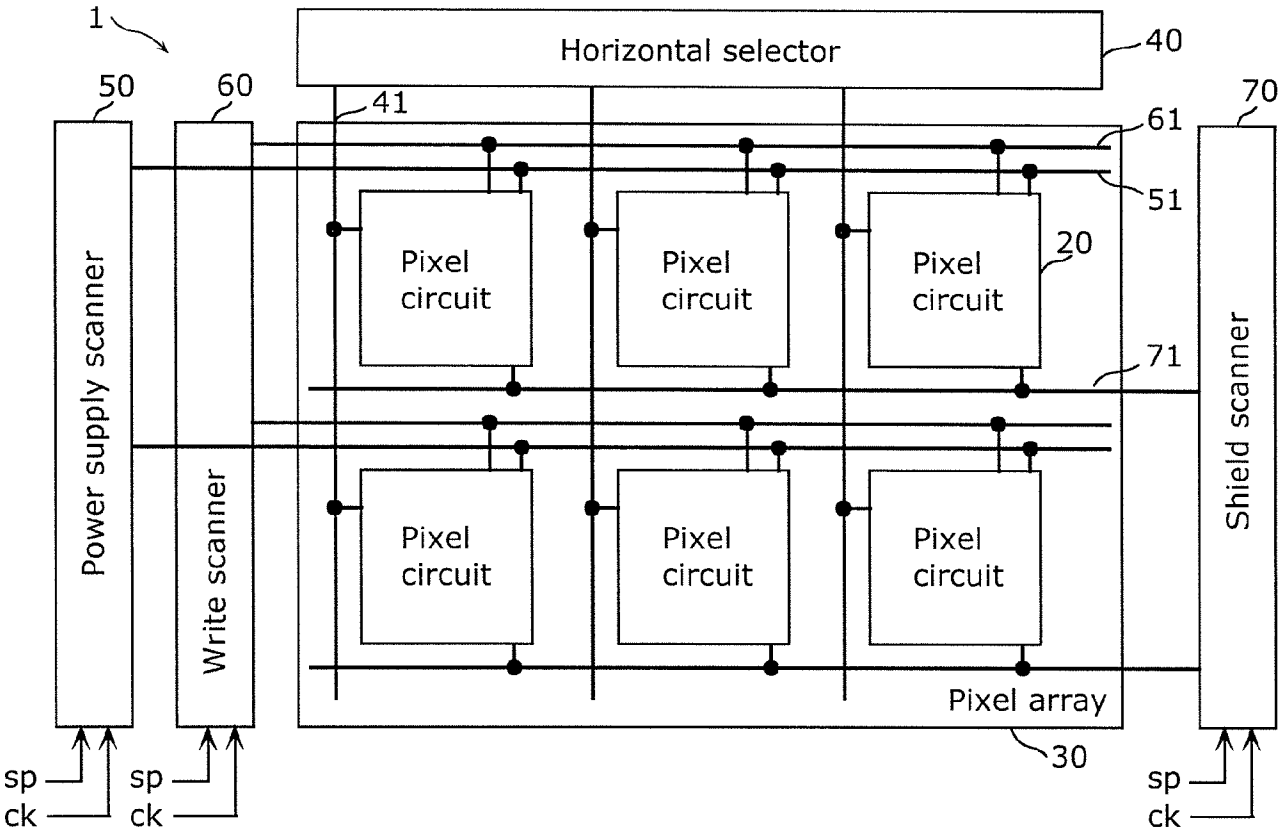
FIG. 15 illustrates a schematic configuration of the display device according to Embodiment 1.

First, the configuration of the display device according to the present embodiment will be described with reference to FIG. 15. FIG. 15 illustrates a schematic configuration of display device 1 according to the present embodiment.

As illustrated in FIG. 15, display device 1 includes pixel array 30, horizontal selector 40, power supply scanner 50, and write scanner 60. Pixel array 30 is comprised of pixel circuits 20 arranged in a two-dimensional matrix. Each pixel circuit 20 includes a light emitting element. In the present embodiment, display device 1 further includes shield scanner 70. Horizontal selector 40, power supply scanner 50, write scanner 60, and shield scanner 70 collectively form a drive circuit unit (drive unit) disposed in the vicinity of pixel array 30.

When display device 1 supports color display, one pixel (unit pixel), which corresponds to a unit of information that makes up a color image, is comprised of a plurality of subpixel circuits. Each of these subpixel circuits corresponds to pixel circuit 20 illustrated in FIG. 15. More specifically, in display device 1, which supports color display, one pixel is comprised of, for example, three subpixel circuits, namely a first subpixel circuit that emits blue light, a second subpixel circuit that emits red light, and a third subpixel circuit that emits green light. Blue light is one example of first color light, red light is one example of light of second color light, and green light is one example of third color light.

However, one pixel is not limited to a combination of three subpixel circuits corresponding to the RGB colors; one pixel may additionally include one or more subpixel circuits corresponding to one or more colors. For example, one pixel may additionally include a subpixel circuit that emits white (W) color for improving luminance, and one pixel may additionally include one or more subpixel circuits that emit complementary color light for a wider color reproduction range.

Moreover, each pixel row in pixel array 30 is provided with power supply line 51, scan line 61, and shield line 71 that extend parallel to the row direction (the direction in which pixel circuits 20 are arranged in a single pixel row) relative to the m rows and n columns of pixels. Furthermore, each pixel column is provided with signal line 41 that extends parallel to the column direction (the direction in which pixel circuits 20 are arranged in a single pixel column) relative to the m rows and n columns of pixels.

Figure 16:
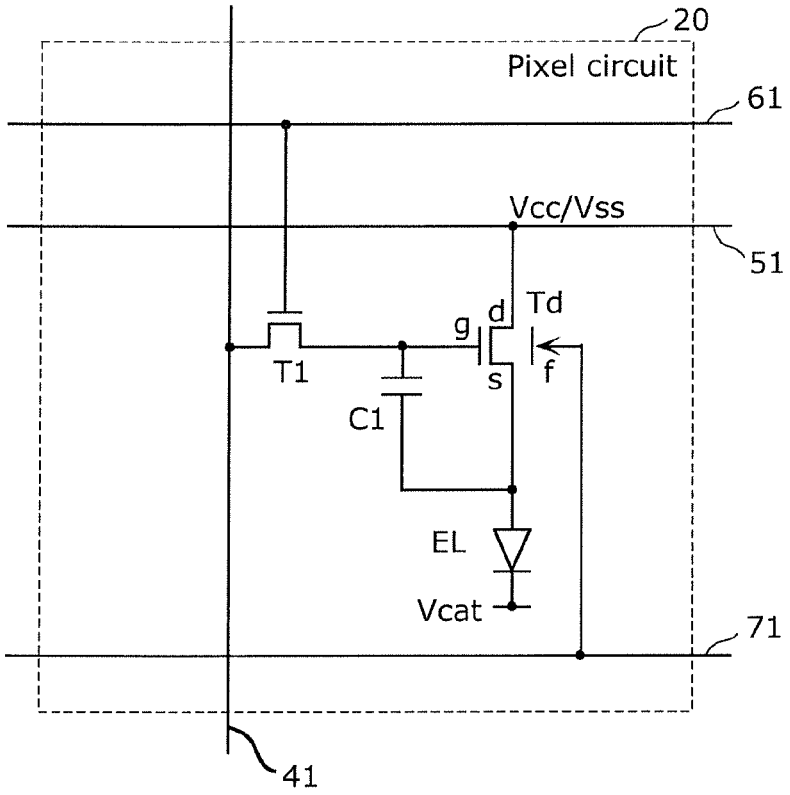
FIG. 16 illustrates a circuit diagram of the pixel circuit according to Embodiment 1.

Pixel circuit 20 is a pixel circuit that emits light based on an image signal. Hereinafter, pixel circuit 20 according to the present embodiment will be described with reference to FIG. 16. FIG. 16 illustrates a circuit diagram of pixel circuit 20 according to the present embodiment.

As illustrated in FIG. 16, pixel circuit 20 is a circuit that causes a light emitting element to emit light at a luminance that corresponds to the image signal, and includes organic EL element EL, storage capacitor C1, write transistor T1, and driver transistor Td. Pixel circuit 20 may further include, for example, a reference transistor and an initialization transistor. The reference transistor is a thin film transistor for applying a reference voltage to storage capacitor C1, and the initialization transistor is a thin film transistor for initializing the potential of a first electrode of organic EL element EL.

Organic EL element EL is one example of a light emitting element including a first electrode and a second electrode. In the example illustrated in FIG. 16, the first electrode and the second electrode are respectively the anode and the cathode of organic EL element EL. The second electrode of organic EL element EL is connected to a cathode power supply line. The cathode power supply line is supplied with cathode potential Vcat. In the present embodiment, cathode potential Vcat is 0V. Organic EL element EL is one example of the light emitting element. The cathode power supply line is wired commonly to all pixel circuits 20.

Storage capacitor C1 is an element for storing voltage, and is connected between gate electrode g and source electrode s of driver transistor Td.

Write transistor T1 is a thin film transistor for applying voltage that corresponds to the image signal to storage capacitor C1. Write transistor T1 is connected between signal line 41 to which the image signal is applied and gate electrode g of driver transistor Td. More specifically, signal line 41 is connected to one of the drain electrode and the source electrode of write transistor T1, and storage capacitor C1 and gate electrode g of driver transistor Td are connected to the other of the drain electrode and the source electrode of write transistor T1. Scan line 61 is connected to the gate electrode of write transistor T1. For example, write transistor T1 enters an ON state in accordance with an ON signal (i.e., a high potential signal), and stores voltage corresponding to the image signal in storage capacitor C1.

Driver transistor Td is an N-channel thin film transistor that is connected to the first electrode (anode) of organic EL element EL and supplies current dependent on the voltage stored in storage capacitor C1 to organic EL element EL. Driver transistor Td includes gate electrode g, counter electrode f disposed opposite gate electrode g, and a channel disposed between gate electrode g and counter electrode f. Next, the structure of driver transistor Td will be described in comparison to the structure of driver transistor T2 that includes the conventional pixel circuits 920, with reference to FIG. 17 and FIG. 18.

Figure 17:
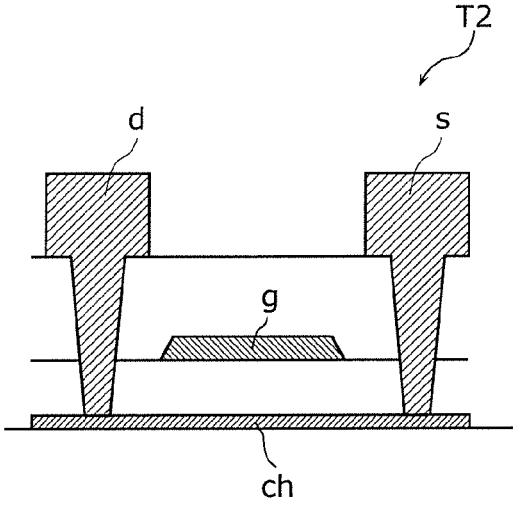
FIG. 17 PRIOR ART
FIG. 17 is a cross sectional diagram schematically depicting the structure of the driver transistor included in the conventional pixel circuit.
Figure 18:
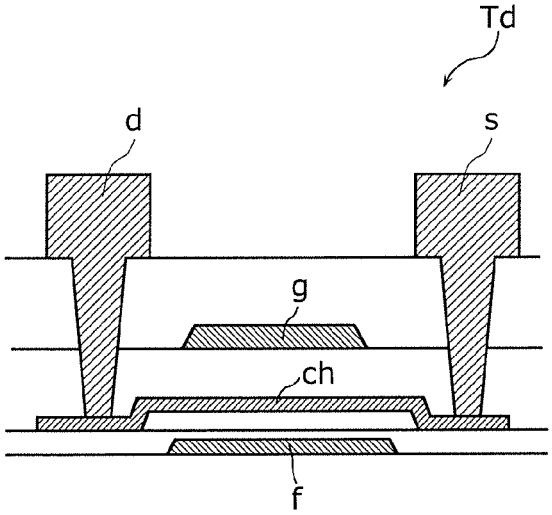
FIG. 18 is a cross sectional diagram schematically depicting the structure of the driver transistor according to Embodiment 1.

FIG. 17 is a cross sectional diagram schematically depicting the structure of driver transistor T2 included in the conventional pixel circuit 920, and FIG. 18 is a cross sectional diagram schematically depicting the structure of driver transistor Td according to the present embodiment. As illustrated in FIG. 17, driver transistor T2 included in the conventional pixel circuit 920 includes gate electrode g, drain electrode d, source electrode s, and channel ch. Although not illustrated in the figure, adjacent electrodes are insulated from one another with insulating layers. Moreover, there is no functional difference between drain electrode d and source electrode s; the high potential side becomes drain electrode d and the low potential side becomes source electrode s. On the other hand, driver transistor Td according to the present embodiment includes gate electrode g, drain electrode d, source electrode s, and channel ch, just like driver transistor T2, but also additionally includes counter electrode f. As illustrated in FIG. 18, counter electrode f is positioned opposite gate electrode g with channel ch disposed therebetween. With this, it is possible to generate electrons in channel ch by applying a potential to counter electrode f that is equivalent to the potential applied to gate electrode g, so counter electrode f functions in the same manner as gate electrode g. In other words, driver transistor Td can function as a circuit that is equivalent to a circuit in which two driver transistors T2 are connected in parallel between the drain and source. Accordingly, by applying a high potential to counter electrode f, it is possible to reduce the resistance value of driver transistor Td to a lower value than when a low potential is applied.

Note that in FIG. 18, driver transistor Td is exemplified as a top gate thin film transistor, but driver transistor Td may be a bottom gate thin film transistor.

Source electrode s of driver transistor Td is connected to the first electrode of organic EL element EL, and drain electrode d is connected to power supply line 51. First potential Vcc or second potential Vss is selectively supplied to power supply line 51 from power supply scanner 50. Counter electrode f also functions as a shield electrode that shields the channel. Either high-resistance potential Vh or low-resistance potential Vl is selectively applied to counter electrode f from shield scanner 70 via a shield line (potential application line) 71. Low-resistance potential Vl is a potential that, as a result of being applied to counter electrode f, reduces the resistance value of driver transistor Td to a lower value than when high-resistance potential Vh is applied to counter electrode f. Here, the resistance value of driver transistor Td means the resistance value of the channel of driver transistor Td. When driver transistor Td is an N-channel thin film transistor, as is the case in the present embodiment, low-resistance potential Vl is higher than high-resistance potential Vh.

For example, an N-channel TFT can be used as write transistor T1, but the conductivity type of write transistor T1 is not limited to this example.

Moreover, depending on the relationship between the potential of the first electrode of organic EL element EL and the potential supplied from power supply line 51, the positional relationship of source electrode s and drain electrode d in driver transistor Td can be changed from the relationship illustrated in FIG. 16.

Horizontal selector 40 is a drive circuit that applies an image signal to signal line 41, and has the same configuration as horizontal selector 40 included in the above-described conventional display device 901.

Power supply scanner 50 is a drive circuit that applies, via power supply line 51, a potential to source electrode s or drain electrode d of driver transistor Td included in pixel circuit 20, and has the same configuration as power supply scanner 50 included in the above-described conventional display device 901.

Write scanner 60 is a drive circuit that controls write transistor T1 included in pixel circuit 20 by applying a potential to scan line 61, and has the same configuration as write scanner 60 included in the above-described conventional display device 901.

Shield scanner 70 (potential application scan circuit) is configured of, for example, a shift register circuit that sequentially shifts (transfers) start pulses sp in synchronization with clock pulse ck. Shield scanner 70 applies low-resistance potential Vl to counter electrode f of driver transistor Td in a write period in which write transistor T1 conducts current in a state in which an image signal is applied to signal line 41 (i.e., in a mobility correction period). Shield scanner 70 applies high-resistance potential Vh to counter electrode f of driver transistor Td in an emission period of organic EL element EL. Shield scanner 70 sequentially applies high-resistance potential Vh and low-resistance potential Vl to each pixel circuit 20 in pixel array 30 on a row-by-row basis.

1-2. Circuit Operations

Figure 19:
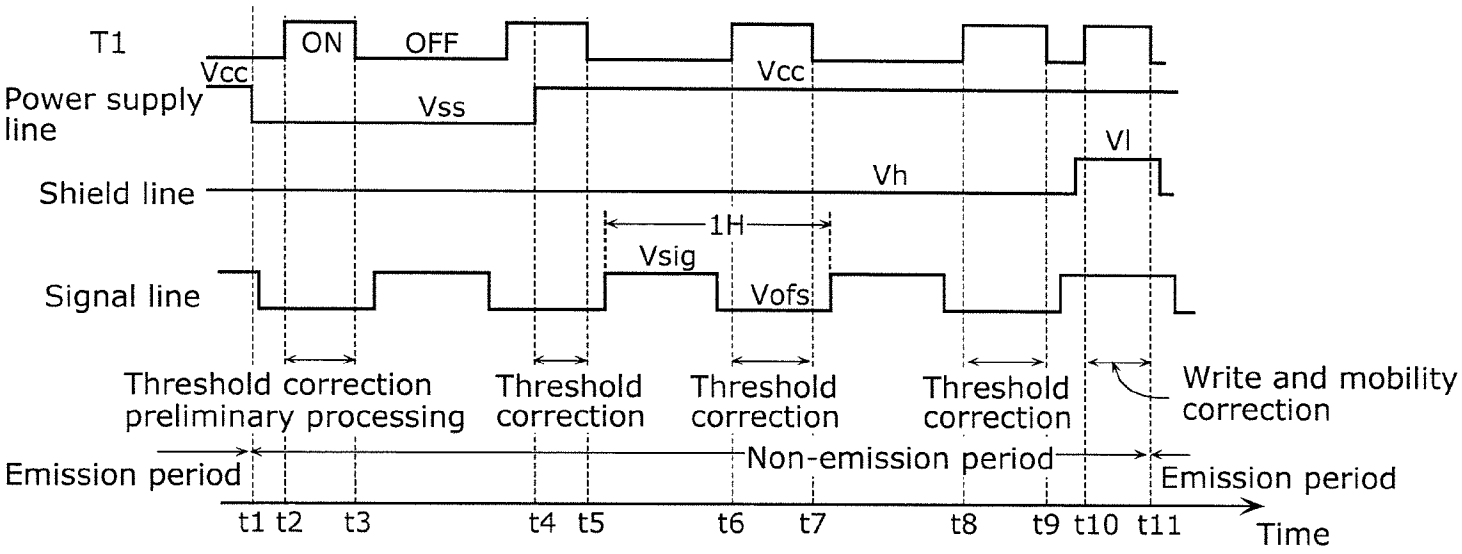
FIG. 19 is a timing chart for describing circuit operations performed by the display device according to Embodiment 1.

Next, circuit operations performed by display device 1 according to the present embodiment will be described with reference to FIG. 19. FIG. 19 is a timing chart for describing circuit operations performed by display device 1 according to the present embodiment. FIG. 19 illustrates changes in the potential of the gate electrode of write transistor T1 (i.e., the potential of scan line 61; either a high potential (ON) or low potential (OFF)), the potential (Vcc or Vss) of power supply line 51, the potential (Vh or Vl) of shield line 71, and the potential (Vsig or Vofs) of signal line 41. In the present embodiment, potential Vcc is approximately 20V, potential Vss is approximately −5V, high-resistance potential Vh is approximately −5V, low-resistance potential V1 is approximately 10V, and potential Vofs is 0V.

As illustrated in FIG. 19, display device 1 according to the present embodiment operates the same as the conventional display device 901, except for the addition of shield line 71. In display device 1 according the present embodiment, just like the conventional display device 901, threshold correction is performed in the non-emission period, and after the threshold correction, signal voltage Vsig is written to pixel circuit 20 and mobility correction is performed.

In the present embodiment, in the write period in which write transistor T1 conducts current in a state in which an image signal is applied to signal line 41 (i.e., in the period from time t10 to time t11), low-resistance potential Vl is applied to counter electrode f of driver transistor Td, and in the emission period of organic EL element EL, high-resistance potential Vh is applied to counter electrode f. With this, in the write and mobility correction period, since the resistance value of driver transistor Td decreases, the drain-source current that flows through driver transistor Td can be increased. Accordingly, source potential Vs can be increased in a shorter period of time. Stated differently, mobility correction can be sped up. Consequently, in display device 1, it is possible to inhibit abnormalities such as cut-off lines and uneven regions in the image, that is to say, inhibit unevenness of images.

Note that reducing the resistance value of driver transistor Td causes display device 1 to operate sensitively with respect to the variations in the potential of gate electrode g of driver transistor Td. Accordingly, driver transistor Td is easily influenced by noise such as coupling noise. This may result in noise being generated in the image displayed by display device 1. However, with pixel circuit 20 according to the present embodiment, since the resistance value of driver transistor Td only decreases in the write and mobility correction period, it is possible to inhibit the influence of noise on driver transistor Td in other periods.

1-3. Technical Advantages, Etc.

As described above, pixel circuit 20 according to the present embodiment is configured to emit light based on an image signal, and includes organic EL element EL, driver transistor Td configured to adjust current supplied to organic EL element EL, and write transistor T1 connected between signal line 41 to which the image signal is applied and driver transistor Td. Driver transistor Td includes gate electrode g, counter electrode f disposed opposite gate electrode g, and channel ch disposed between gate electrode g and counter electrode f. A potential applied to counter electrode f in a write period in which write transistor T1 conducts current in a state in which the image signal is applied to signal line 41 reduces a resistance value of driver transistor Td to a lower value than a potential applied to counter electrode f in an emission period of organic EL element EL does.

In this way, with pixel circuit 20 according to the present embodiment, low-resistance potential Vl is applied to counter electrode f of driver transistor Td in the write and mobility correction period, and high-resistance potential Vh is applied to counter electrode f in the emission period of organic EL element EL. With this, in the write and mobility correction period, since the resistance value of driver transistor Td decreases, the drain-source current that flows through driver transistor Td can be increased. Accordingly, source potential Vs can be increased in a shorter period of time. Stated differently, mobility correction can be sped up. Consequently, in display device 1 including a plurality of pixel circuits 20, image unevenness (i.e., image non-uniformity) resulting from variations in mobility between pixel circuits 20 can be reduced.

Moreover, with pixel circuit 20, due to high-resistance potential Vh being applied to counter electrode f, in at least the emission period, the resistance value of driver transistor Td in the emission period can be reduced. Accordingly, it is possible to inhibit the influence of noise in periods other than the write and mobility correction period.

Moreover, the display device according to the present embodiment includes pixel circuit 20, horizontal selector 40 configured to apply an image signal to signal line 41, write scanner 60 configured to control write transistor T1, and power supply scanner 50 configured to apply a potential to source electrode s or drain electrode d of driver transistor Td.

This allows for sufficient mobility correction since the mobility correction of driver transistor Td in pixel circuit 20 can be sped up. Consequently, when display device 1 includes a plurality of pixel circuits, image unevenness (i.e., image non-uniformity) resulting from variations in mobility between pixel circuits 20 can be reduced.

Embodiment 2

Next, a pixel circuit and a display device according to Embodiment 2 will be described. The display device according to the present embodiment differs from display device 1 according to Embodiment 1 in that shield scanner 70 is omitted. The following description of the pixel circuit and the display device according to the present embodiment will focus on the points of difference from pixel circuit 20 and display device 1 according to Embodiment 1.

2-1. Display Device Configuration

Figure 20:
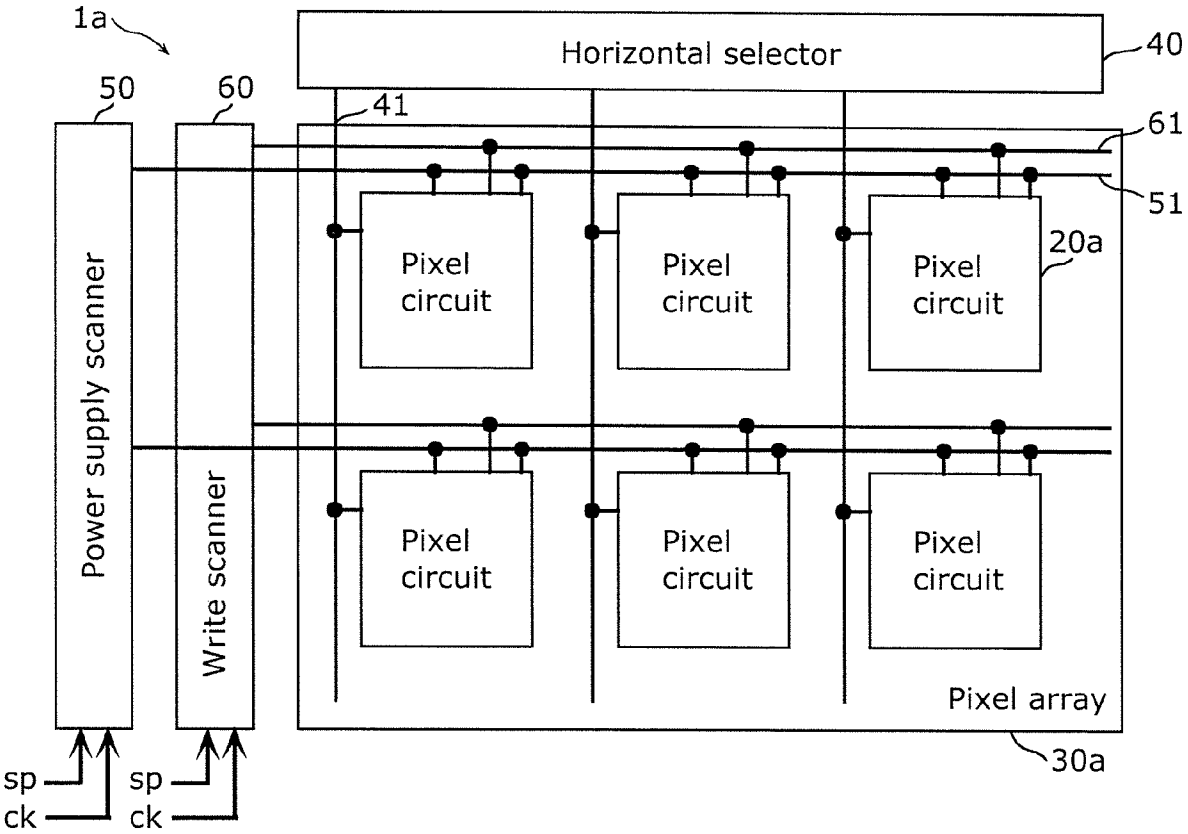
FIG. 20 illustrates a schematic configuration of the display device according to Embodiment 2.

First, the configuration of the display device according to the present embodiment will be described with reference to FIG. 20. FIG. 20 illustrates a schematic configuration of display device 1*a* according to the present embodiment.

As illustrated in FIG. 20, display device 1*a* includes pixel array 30*a*, horizontal selector 40, power supply scanner 50, and write scanner 60. Pixel array 30*a* is comprised of pixel circuits 20*a* arranged in a two-dimensional matrix. Each pixel circuit 20*a* includes a light emitting element. Horizontal selector 40, power supply scanner 50, and write scanner 60 have the same configurations as horizontal selector 40, power supply scanner 50, and write scanner 60 according to Embodiment 1, respectively.

Each pixel row in pixel array 30*a* is provided with power supply line 51 and scan line 61 that extend parallel to the row direction (the direction in which pixel circuits 20*a* are arranged in a single pixel row) relative to the m rows and n columns of pixels. Furthermore, each pixel column is provided with signal line 41 that extends parallel to the column direction (the direction in which pixel circuits 20*a* are arranged in a single pixel column) relative to the m rows and n columns of pixels.

Figure 21:
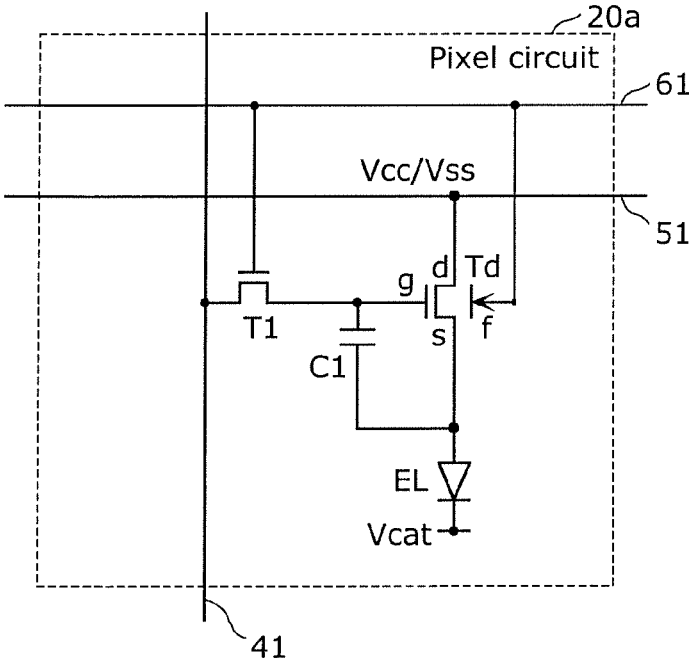
FIG. 21 illustrates a circuit diagram of the pixel circuit according to Embodiment 2.

Pixel circuit 20*a* is a pixel circuit that emits light based on an image signal. Hereinafter, pixel circuit 20*a* according to the present embodiment will be described with reference to FIG. 21. FIG. 21 illustrates a circuit diagram of pixel circuit 20*a* according to the present embodiment.

As illustrated in FIG. 21, just like pixel circuit 20 according to Embodiment 1, pixel circuit 20*a* includes organic EL element EL, storage capacitor C1, write transistor T1, and driver transistor Td.

Pixel circuit 20*a* according to the present embodiment differs from pixel circuit 20 according to Embodiment 1 in that counter electrode f of driver transistor Td is connected to scan line 61. In the present embodiment, the potential that is applied to counter electrode f is equal to the gate potential of write transistor T1.

2-2. Circuit Operations

Figure 22:
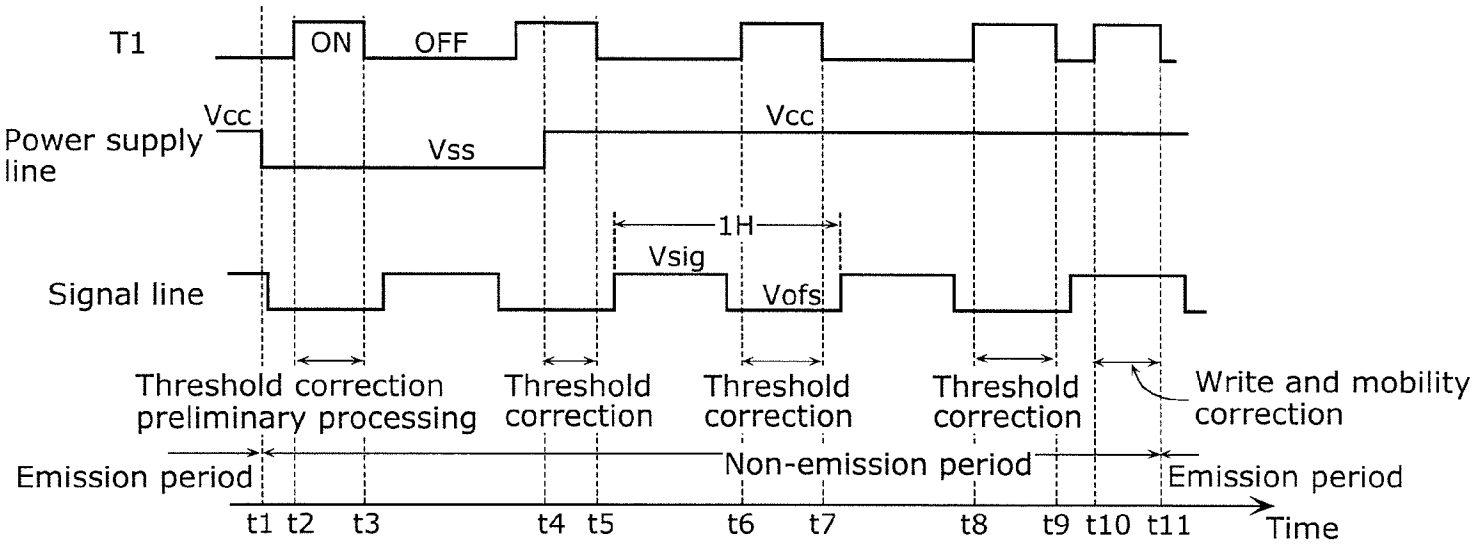
FIG. 22 is a timing chart for describing circuit operations performed by the display device according to Embodiment 2.

Next, circuit operations performed by display device 1*a* according to the present embodiment will be described with reference to FIG. 22. FIG. 22 is a timing chart for describing circuit operations performed by display device 1*a* according to the present embodiment. Similar to FIG. 19, FIG. 22 illustrates changes in the potential of the gate electrode of write transistor T1, the potential of power supply line 51, and the potential of signal line 41.

As illustrated in FIG. 22, according to the present embodiment, the potential of the gate electrode of write transistor T1, the potential of power supply line 51, and the potential of signal line 41 change in the same manner as Embodiment 1.

In the present embodiment, since a potential equal to the potential of the gate electrode of write transistor T1 is applied to counter electrode f of driver transistor Td, a high potential is applied in the write and mobility correction period, and a low potential is applied in the emission period. In other words, in the present embodiment as well, the potential applied to counter electrode f in the write and mobility correction period reduces the resistance value of driver transistor Td to a lower value than the potential applied to counter electrode f in the emission period does.

Accordingly, just like in pixel circuit 20 according to Embodiment 1, mobility correction can be sped up in pixel circuit 20*a* according to the present embodiment as well. Consequently, in display device 1*a* including a plurality of pixel circuits 20*a*, image unevenness (i.e., image non-uniformity) resulting from variations in mobility between pixel circuits 20*a* can be reduced.

Moreover, in periods other than the write and mobility correction period, the period in which a high potential is applied to counter electrode f is limited to only periods in which threshold correction (or threshold correction preliminary processing) is performed. Accordingly, it is possible to inhibit the influence of noise in periods other than the write and mobility correction period, more so than when a high potential is always applied to counter electrode f.

2-3. Technical Advantages, Etc

As described above, in pixel circuit 20*a* according to the present embodiment, the potential that is applied to counter electrode f is equal to the gate potential of write transistor T1.

Just like with pixel circuit 20 according to Embodiment 1, it is possible to speed up mobility correction and reduce noise with the above configuration as well. Moreover, in pixel circuit 20*a* according to the present embodiment, since shield scanner 70 and shield line 71 used in pixel circuit 20 according to Embodiment 1 are not necessary, the configuration of pixel circuit 20*a* is simpler than the configuration of pixel circuit 20 according to Embodiment 1. Accordingly, drive circuit units located at the edges of display device 1*a* can be simplified, which makes it possible to give display device 1*a* a narrow border.

Embodiment 3

Next, a pixel circuit and a display device according to Embodiment 3 will be described. The display device according to the present embodiment mainly differs from pixel circuit 20 and display device 1 according to Embodiment 1 in that transistors for switching applied potentials are connected to counter electrode f of driver transistor Td. The following description of the pixel circuit and the display device according to the present embodiment will focus on the points of difference from pixel circuit 20 and display device 1 according to Embodiment 1.

3-1. Display Device Configuration

Figure 23:
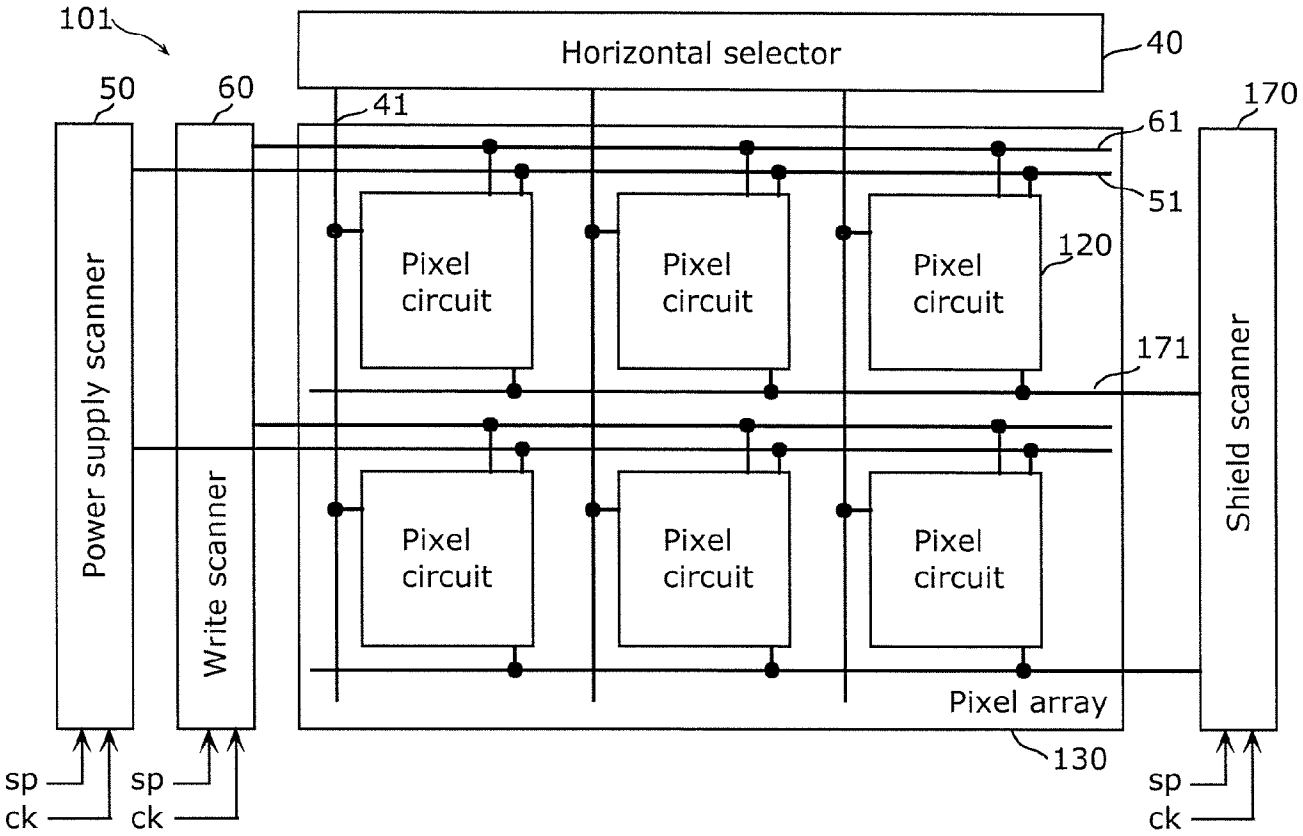
FIG. 23 illustrates a schematic configuration of the display device according to Embodiment 3.

First, the configuration of the display device according to the present embodiment will be described with reference to FIG. 23. FIG. 23 illustrates a schematic configuration of display device 101 according to the present embodiment.

As illustrated in FIG. 23, display device 101 includes pixel array 130, horizontal selector 40, power supply scanner 50, write scanner 60, and shield scanner 170. Pixel array 130 is comprised of pixel circuits 120 arranged in a two-dimensional matrix. Each pixel circuit 120 includes a light emitting element. Horizontal selector 40, power supply scanner 50, and write scanner 60 have the same configurations as horizontal selector 40, power supply scanner 50, and write scanner 60 according to Embodiment 1, respectively.

Shield scanner 170 (potential application scan circuit) according to the present embodiment is configured of, for example, a shift register circuit that sequentially shifts (transfers) start pulses sp in synchronization with clock pulse ck. Shield scanner 170 applies a high level potential to shield line 171 in a write period in which write transistor T1 conducts current in a state in which an image signal is applied to signal line 41 (i.e., in a mobility correction period). Shield scanner 170 applies a low level potential to shield line 171 in the emission period of organic EL element EL. Shield scanner 170 sequentially applies a high level or low level potential to each pixel circuit 120 in pixel array 130 on a row-by-row basis.

Moreover, each pixel row in pixel array 130 is provided with power supply line 51, scan line 61, and shield line 171 that extend parallel to the row direction (the direction in which pixel circuits 120 are arranged in a single pixel row) relative to the m rows and n columns of pixels. Furthermore, each pixel column is provided with signal line 41 that extends parallel to the column direction (the direction in which pixel circuits 120 are arranged in a single pixel column) relative to the m rows and n columns of pixels.

Figure 24:
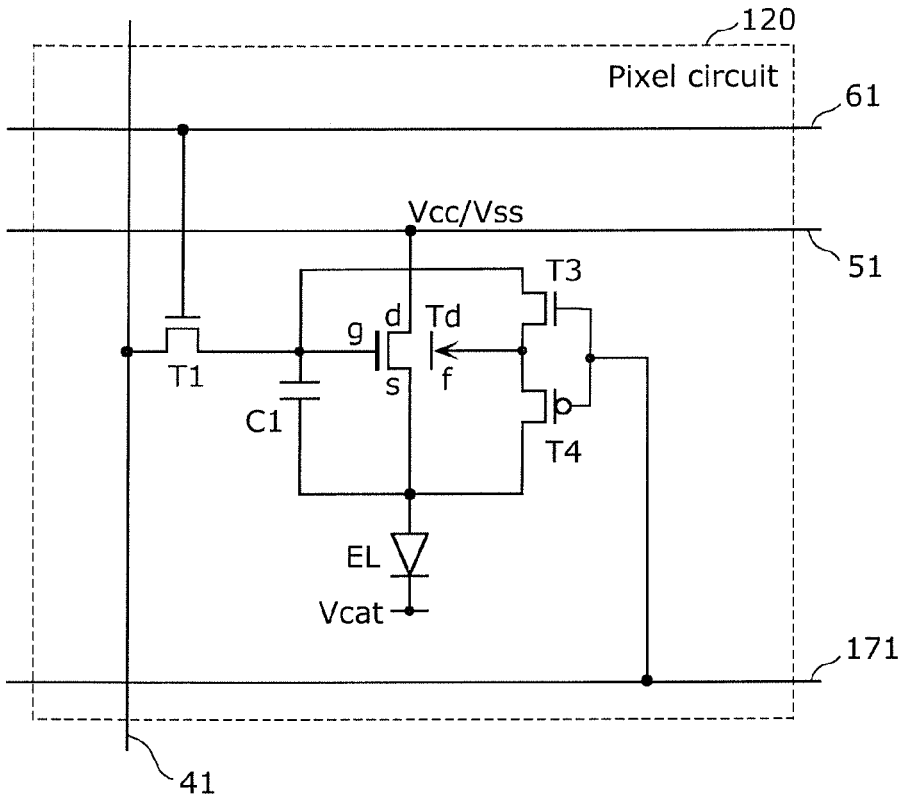
FIG. 24 illustrates a circuit diagram of the pixel circuit according to Embodiment 3.

Pixel circuit 120 is a pixel circuit that emits light based on an image signal. Hereinafter, pixel circuit 120 according to the present embodiment will be described with reference to FIG. 24. FIG. 24 illustrates a circuit diagram of pixel circuit 120 according to the present embodiment.

As illustrated in FIG. 24, just like pixel circuit 20 according to Embodiment 1, pixel circuit 120 includes organic EL element EL, storage capacitor C1, write transistor T1, and driver transistor Td. In the present embodiment, pixel circuit 120 further includes a pair of switching transistors connected to counter electrode f. In the present embodiment, the pair of switching transistors includes N-channel transistor T3 and P-channel transistor T4 that share a gate.

The drain electrode of N-channel transistor T3 is connected to gate electrode g of driver transistor Td, the source electrode of N-channel transistor T3 is connected to counter electrode f of driver transistor Td, and the gate electrode of N-channel transistor T3 is connected to shield line 171.

The source electrode of P-channel transistor T4 is connected to counter electrode f of driver transistor Td, the drain electrode of P-channel transistor T4 is connected to source electrode s of driver transistor Td, and the gate electrode of P-channel transistor T4 is connected to shield line 171.

In the present embodiment, since the gate potential of driver transistor Td is higher than the source potential (see FIG. 4), N-channel transistor T3 can be said to be connected to a point of higher potential than P-channel transistor T4.

3-2. Circuit Operations

Next, circuit operations performed by display device 101 according to the present embodiment will be described. According to the present embodiment, the potential of the gate electrode of write transistor T1, the potential of power supply line 51, and the potential of signal line 41 change in the same manner as shown in the timing chart illustrated in FIG. 19. The potential applied from shield scanner 170 to shield line 171 changes in the same manner as the potential of the shield line illustrated in FIG. 19, but the value of the potential is different from the example illustrated in FIG. 19. The voltage applied from shield scanner 170 to shield line 171 is a low level potential up until immediately before time t10, and is a high level potential from time t10 up until immediately after time t11. Here, the high level potential is a potential that is sufficiently high enough to, when applied to the gate electrode of N-channel transistor T3 and P-channel transistor T4, place N-channel transistor T3 in a conducting state and P-channel transistor T4 in a non-conducting state. The low level potential is a potential that is sufficiently low enough to, when applied to the gate electrode of N-channel transistor T3 and P-channel transistor T4, place N-channel transistor T3 in a non-conducting state and P-channel transistor T4 in a conducting state.

Accordingly, in the present embodiment, in the period from time t10 to time t11, N-channel transistor T3 is in a conducting state and P-channel transistor T4 is in a non-conducting state. Accordingly, a potential equal to the potential at gate electrode g is applied to counter electrode f of driver transistor Td. On the other hand, in other periods, N-channel transistor T3 is in a non-conducting state and P-channel transistor T4 is in a conducting state. Accordingly, a potential equal to the potential at source electrode s is applied to counter electrode f of driver transistor Td. Since the gate potential of driver transistor Td is higher than the source potential, just like in Embodiment 1, the potential applied to counter electrode fin the write period reduces the resistance value of driver transistor Td to a lower value than the potential applied to counter electrode f in the emission period does in the present embodiment as well. Accordingly, pixel circuit 120 according to the present embodiment has the same technical advantages as Embodiment 1.

Furthermore, in the present embodiment, since the gate potential of driver transistor Td is applied as a low-resistance potential, current corresponding to signal voltage Vsig flows in mobility correction. Accordingly, since driver transistor Td assumes a value corresponding to signal voltage Vsig, it is possible to inhibit mobility over-correction when signal voltage Vsig is low.

3-3. Technical Advantages, Etc.

As described above, in pixel circuit 120 according to the present embodiment, the potential applied to counter electrode f in the write period is the gate potential of driver transistor Td, and the potential applied to counter electrode f in the emission period is a potential that increases the resistance value of driver transistor Td to a higher value than the resistance value of driver transistor Td in the write period. More specifically, the potential applied to counter electrode f in the emission period is the source potential of driver transistor Td.

Such a configuration has the same technical advantages as pixel circuit 20 according to Embodiment 1. Moreover, in the present embodiment, since the potential applied to counter electrode f in the write period is the gate potential of driver transistor Td, a current corresponding to signal voltage Vsig flows in mobility correction. Accordingly, since driver transistor Td assumes a value corresponding to signal voltage Vsig, it is possible to inhibit mobility over-correction when signal voltage Vsig is low.

In pixel circuit 120 according to the present embodiment, N-channel transistor T3 is connected between gate electrode g and counter electrode f of driver transistor Td, and P-channel transistor T4 is connected between source electrode s and counter electrode f of driver transistor Td. However, the circuit configuration of pixel circuit 120 according to the present embodiment is not limited to this example. For example, in pixel circuit 120, the P-channel transistor may be connected between gate electrode g and counter electrode f of driver transistor Td, and the N-channel transistor may be connected between source electrode s and counter electrode f of driver transistor Td. In other words, in pixel circuit 120, the locations at which N-channel transistor T3 and P-channel transistor T4 are connected may be swapped. In such cases, if the potential applied from shield scanner 170 to shield line 171 is reversed, that is to say, if a high level potential is applied to shield line 171 up until immediately before time t10 and a low level signal is applied to shield line 171 from time t10 to time t11, the result is a pixel circuit that operates in the same manner as pixel circuit 120.

Moreover, in pixel circuit 120 according to the present embodiment, a pair of switching transistors may be further connected to counter electrode f, and the potential applied to counter electrode f may be selected according to ON and OFF states of the pair of switching transistors.

Moreover, in pixel circuit 120 according to the present embodiment, the pair of switching transistors may include an N-channel transistor and a P-channel transistor that share a gate.

Embodiment 4

Next, a pixel circuit and a display device according to Embodiment 4 will be described. The display device according to the present embodiment differs from display device 101 according to Embodiment 3 in that shield scanner 170 is omitted. The following description of the pixel circuit and the display device according to the present embodiment will focus on the points of difference from pixel circuit 120 and display device 101 according to Embodiment 3.

4-1. Display Device Configuration

Figure 25:
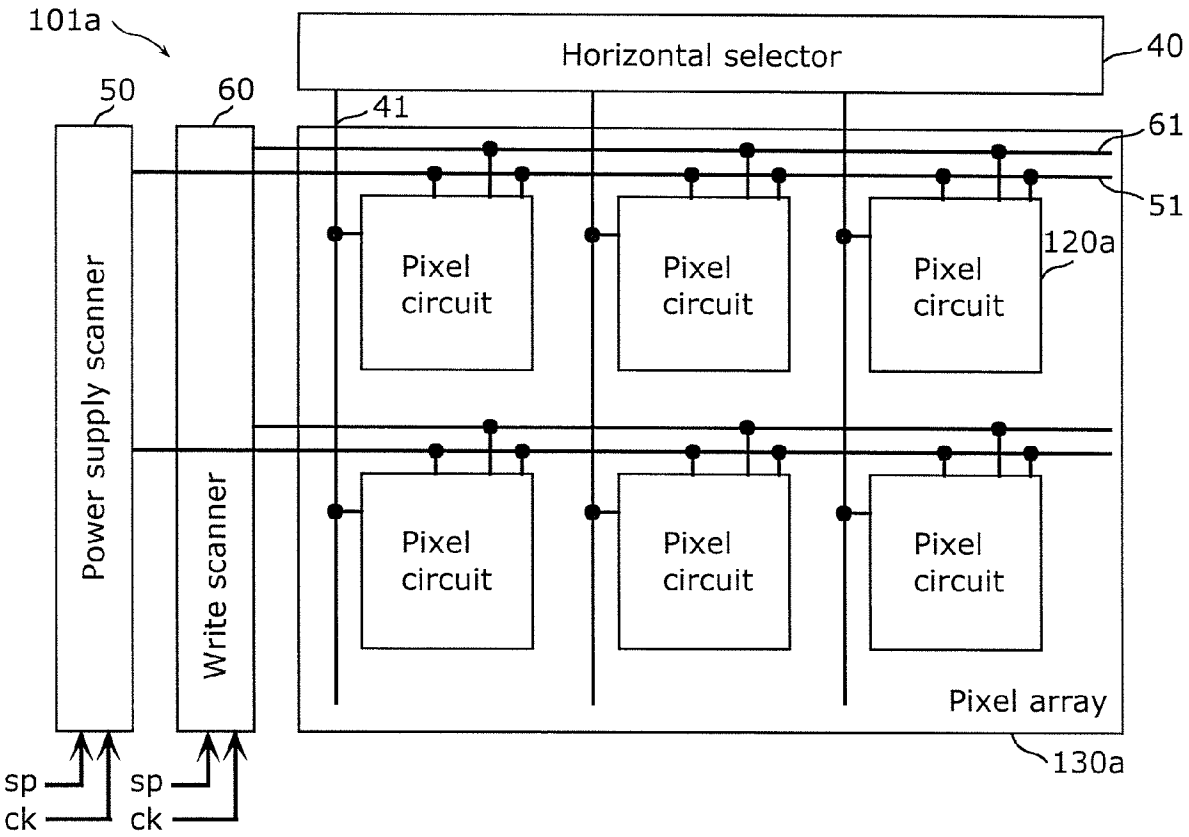
FIG. 25 illustrates a schematic configuration of the display device according to Embodiment 4.

First, the configuration of the display device according to the present embodiment will be described with reference to FIG. 25. FIG. 25 illustrates a schematic configuration of display device 101*a* according to the present embodiment.

As illustrated in FIG. 25, display device 101*a* includes pixel array 130*a*, horizontal selector 40, power supply scanner 50, and write scanner 60. Pixel array 130*a* is comprised of pixel circuits 120*a* arranged in a two-dimensional matrix. Each pixel circuit 120*a* includes a light emitting element. Horizontal selector 40, power supply scanner 50, and write scanner 60 have the same configurations as horizontal selector 40, power supply scanner 50, and write scanner 60 according to Embodiment 1, respectively.

Each pixel row in pixel array 130*a* is provided with power supply line 51 and scan line 61 that extend parallel to the row direction (the direction in which pixel circuits 120*a* are arranged in a single pixel row) relative to the m rows and n columns of pixels. Furthermore, each pixel column is provided with signal line 41 that extends parallel to the column direction (the direction in which pixel circuits 120*a* are arranged in a single pixel column) relative to the m rows and n columns of pixels.

Figure 26:
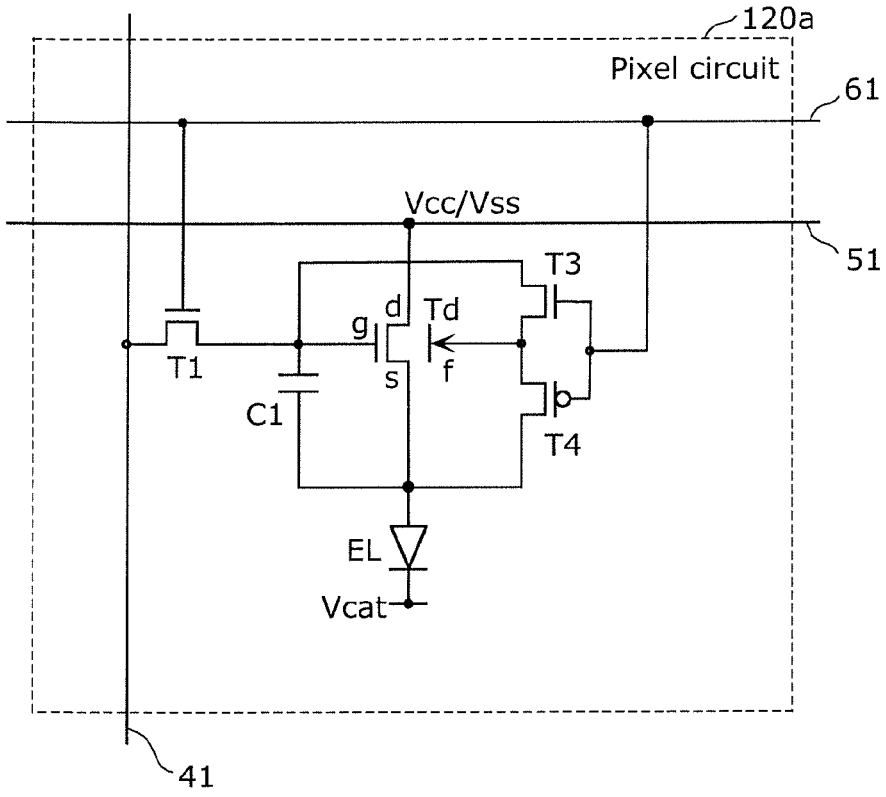
FIG. 26 illustrates a circuit diagram of the pixel circuit according to Embodiment 4.

Pixel circuit 120*a* is a pixel circuit that emits light based on an image signal. Hereinafter, pixel circuit 120*a* according to the present embodiment will be described with reference to FIG. 26. FIG. 26 illustrates a circuit diagram of pixel circuit 120*a* according to the present embodiment.

As illustrated in FIG. 26, just like pixel circuit 120 according to Embodiment 3, pixel circuit 120*a* includes organic EL element EL, storage capacitor C1, write transistor T1, driver transistor Td, N-channel transistor T3, and P-channel transistor T4.

Pixel circuit 120*a* according to the present embodiment differs from pixel circuit 120 according to Embodiment 3 in that the gate electrode of N-channel transistor T3 and P-channel transistor T4 is connected to scan line 61. In the present embodiment, the potential that is applied to the gate electrode of N-channel transistor T3 and P-channel transistor T4 is equal to the gate potential of write transistor T1.

4-2. Circuit Operations

Next, circuit operations performed by display device 101*a* according to the present embodiment will be described. According to the present embodiment, the potential of the gate electrode of write transistor T1, the potential of power supply line 51, and the potential of signal line 41 change in the same manner as Embodiment 3.

In the present embodiment, since a potential equal to the potential of the gate electrode of write transistor T1 is applied to the gate electrode of N-channel transistor T3 and P-channel transistor T4, a high potential is applied in the write and mobility correction period, and a low potential is applied in the emission period. Accordingly, in the write and mobility correction period, N-channel transistor T3 can be placed in a conducting state and P-channel transistor T4 can be placed in a non-conducting state. Moreover, in the emission period, N-channel transistor T3 can be placed in a non-conducting state and P-channel transistor T4 can be placed in a conducting state.

In other words, pixel circuit 120*a* according to the present embodiment can change the potential of counter electrode f of driver transistor Td in the same manner as pixel circuit 120 according to Embodiment 3.

Accordingly, pixel circuit 120*a* according to the present embodiment has the same technical advantages as pixel circuit 120 according to Embodiment 3.

4-3. Technical Advantages, Etc

As described above, in pixel circuit 120*a* according to the present embodiment, the gate potential of the N-channel transistor and the P-channel transistor is equal to the gate potential of write transistor T1.

Such a configuration has the same technical advantages as pixel circuit 120 according to Embodiment 3. Moreover, in pixel circuit 120*a* according to the present embodiment, since shield scanner 170 and shield line 171 used in pixel circuit 120 according to Embodiment 3 are not necessary, the configuration of pixel circuit 120*a* is simpler than the configuration of pixel circuit 120 according to Embodiment 3. Accordingly, drive circuit units located at the edges of display device 101*a* can be simplified, which makes it possible to give display device 101*a* a narrow border.

Embodiment 5

Next, a pixel circuit and a display device according to Embodiment 5 will be described. The pixel circuit according to the present embodiment differs from pixel circuit 120 according to Embodiment 3 in that the P-channel transistor is omitted. The following description of the pixel circuit and the display device according to the present embodiment will focus on the points of difference from pixel circuit 120 and display device 101 according to Embodiment 3.

5-1. Display Device Configuration

Figure 27:
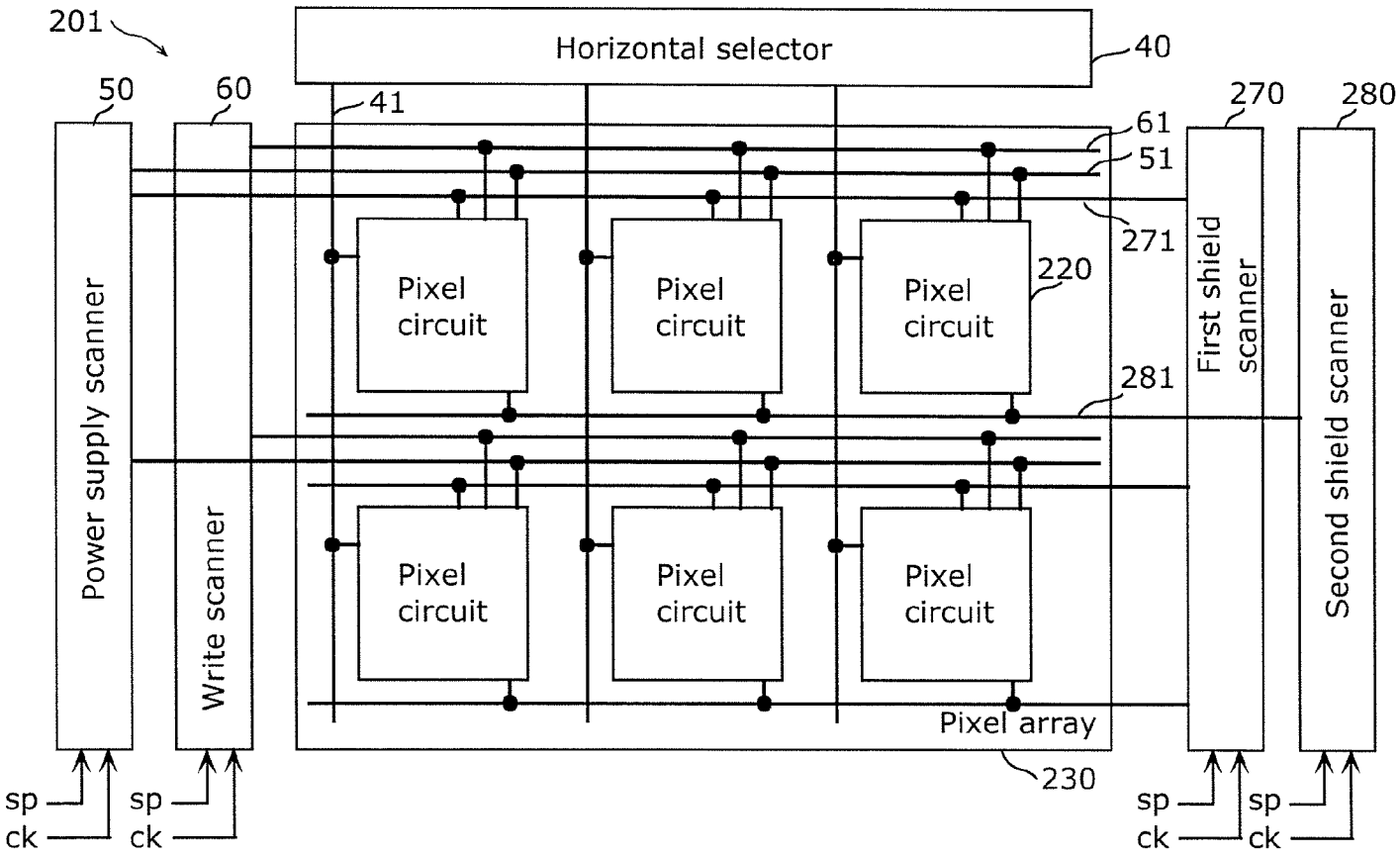
FIG. 27 illustrates a schematic configuration of the display device according to Embodiment 5.

First, the configuration of the display device according to the present embodiment will be described with reference to FIG. 27. FIG. 27 illustrates a schematic configuration of display device 201 according to the present embodiment.

As illustrated in FIG. 27, display device 201 includes pixel array 230, horizontal selector 40, power supply scanner 50, write scanner 60, first shield scanner 270 and second shield scanner 280. Pixel array 230 is comprised of pixel circuits 220 arranged in a two-dimensional matrix. Each pixel circuit 220 includes a light emitting element. Horizontal selector 40, power supply scanner 50, and write scanner 60 have the same configurations as horizontal selector 40, power supply scanner 50, and write scanner 60 according to Embodiment 1, respectively.

First shield scanner 270 (potential application scan circuit) according to the present embodiment is configured of, for example, a shift register circuit that sequentially shifts (transfers) start pulses sp in synchronization with clock pulse ck. First shield scanner 270 applies a high level potential to first shield line 271 in a write period in which write transistor T1 conducts current in a state in which an image signal is applied to signal line 41 (i.e., in a mobility correction period). First shield scanner 270 applies a low level potential to first shield line 271 in the emission period of organic EL element EL. First shield scanner 270 sequentially applies a high level or low level potential to each pixel circuit 220 in pixel array 230 on a row-by-row basis.

Second shield scanner 280 (potential application scan circuit) according to the present embodiment is configured of, for example, a shift register circuit that sequentially shifts (transfers) start pulses sp in synchronization with clock pulse ck. Second shield scanner 280 applies a low level potential to second shield line 281 in a write period in which write transistor T1 conducts current in a state in which an image signal is applied to signal line 41 (i.e., in a mobility correction period). Second shield scanner 280 applies a high level potential to second shield line 281 in the emission period of organic EL element EL. Second shield scanner 280 sequentially applies a low level or high level potential to each pixel circuit 220 in pixel array 230 on a row-by-row basis.

Moreover, each pixel row in pixel array 230 is provided with power supply line 51, scan line 61, first shield line 271, and second shield line 281 that extend parallel to the row direction (the direction in which pixel circuits 220 are arranged in a single pixel row) relative to the m rows and n columns of pixels. Furthermore, each pixel column is provided with signal line 41 that extends parallel to the column direction (the direction in which pixel circuits 220 are arranged in a single pixel column) relative to the m rows and n columns of pixels.

Figure 28:
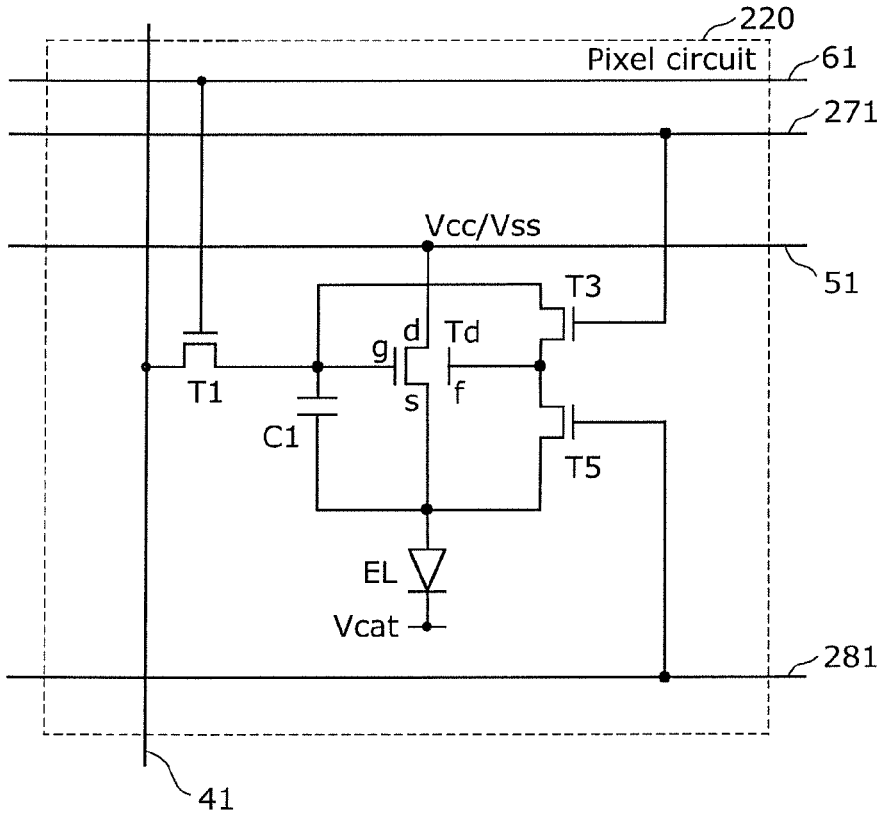
FIG. 28 illustrates a circuit diagram of the pixel circuit according to Embodiment 5.

Pixel circuit 220 is a pixel circuit that emits light based on an image signal. Hereinafter, pixel circuit 220 according to the present embodiment will be described with reference to FIG. 28. FIG. 28 illustrates a circuit diagram of pixel circuit 220 according to the present embodiment.

As illustrated in FIG. 28, just like pixel circuit 120 according to Embodiment 3, pixel circuit 220 includes organic EL element EL, storage capacitor C1, write transistor T1, and driver transistor Td. In the present embodiment, pixel circuit 120 further includes a pair of switching transistors connected to counter electrode f. In the present embodiment, the pair of switching transistors includes two N-channel transistors T3 and T5.

The drain electrode of N-channel transistor T3 is connected to gate electrode g of driver transistor Td, the source electrode of N-channel transistor T3 is connected to counter electrode f of driver transistor Td, and the gate electrode of N-channel transistor T3 is connected to first shield line 271.

The drain electrode of N-channel transistor T5 is connected to counter electrode f of driver transistor Td, the source electrode of N-channel transistor T5 is connected to source electrode s of driver transistor Td, and the gate electrode of N-channel transistor T5 is connected to second shield line 281.

5-2. Circuit Operations

Figure 29:
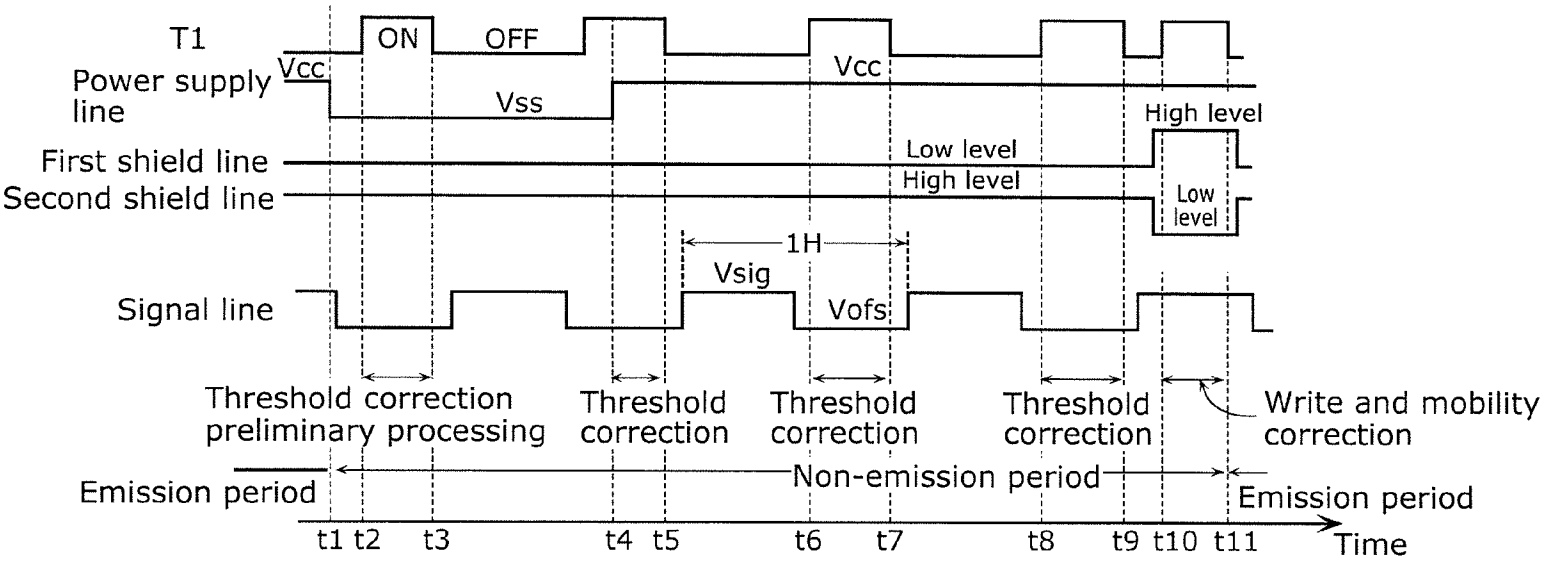
FIG. 29 is a timing chart for describing circuit operations performed by the display device according to Embodiment 5.

Next, circuit operations performed by display device 201 according to the present embodiment will be described with reference to FIG. 29. FIG. 29 is a timing chart for describing circuit operations performed by display device 201 according to the present embodiment. FIG. 29 illustrates changes in the potential of the gate electrode of write transistor T1, the potential of power supply line 51, the potential of first shield line 271, the potential of second shield line 281, and the potential of signal line 41.

As illustrated in FIG. 29, in display device 201 according to the present embodiment, the potential of the gate electrode of write transistor T1, the potential of power supply line 51, and the potential of signal line 41 change in the same manner as display device 101 according to Embodiment 3. The present embodiment differs from display device 101 according to Embodiment 3 in regard to the changes in potentials of first shield line 271 and second shield line 281.

The potential applied from first shield scanner 270 to first shield line 271 is a low level potential up until immediately before time t10, and is a high level potential from time t10 up until immediately after time t11. Here, the high level potential is a potential that is sufficiently high enough to, when applied to the gate electrode of N-channel transistor T3, place N-channel transistor T3 in a conducting state. The low level potential is a potential that is sufficiently low enough to, when applied to the gate electrode of N-channel transistor T3, place N-channel transistor T3 in a non-conducting state.

The potential applied from second shield scanner 280 to second shield line 281 is a high level potential up until immediately before time t10, and is a low level potential from time t10 up until immediately after time t11. Here, the high level potential is a potential that is sufficiently high enough to, when applied to the gate electrode of N-channel transistor T5, place N-channel transistor T5 in a conducting state. The low level potential is a potential that is sufficiently low enough to, when applied to the gate electrode of N-channel transistor T5, place N-channel transistor T5 in a non-conducting state.

Accordingly, in the present embodiment, in the period from time t10 to time t11, N-channel transistor T3 is in a conducting state and N-channel transistor T5 is in a non-conducting state. Accordingly, a potential equal to the potential at gate electrode g is applied to counter electrode f of driver transistor Td. On the other hand, in other periods, N-channel transistor T3 is in a non-conducting state and N-channel transistor T5 is in a conducting state. Accordingly, a potential equal to the potential at source electrode s is applied to counter electrode f of driver transistor Td. Since the gate potential of driver transistor Td is higher than the source potential, just like in Embodiment 3, the potential applied to counter electrode fin the write period reduces the resistance value of driver transistor Td to a lower value than the potential applied to counter electrode f in the emission period does in the present embodiment as well. Accordingly, pixel circuit 220 according to the present embodiment has the same technical advantages as Embodiment 3.

Furthermore, in pixel circuit 220 according to the present embodiment, since a P-channel transistor is not necessary, even semiconductor materials that are difficult to form a P-channel transistor with can be used.

5-3. Variation

Figure 30:
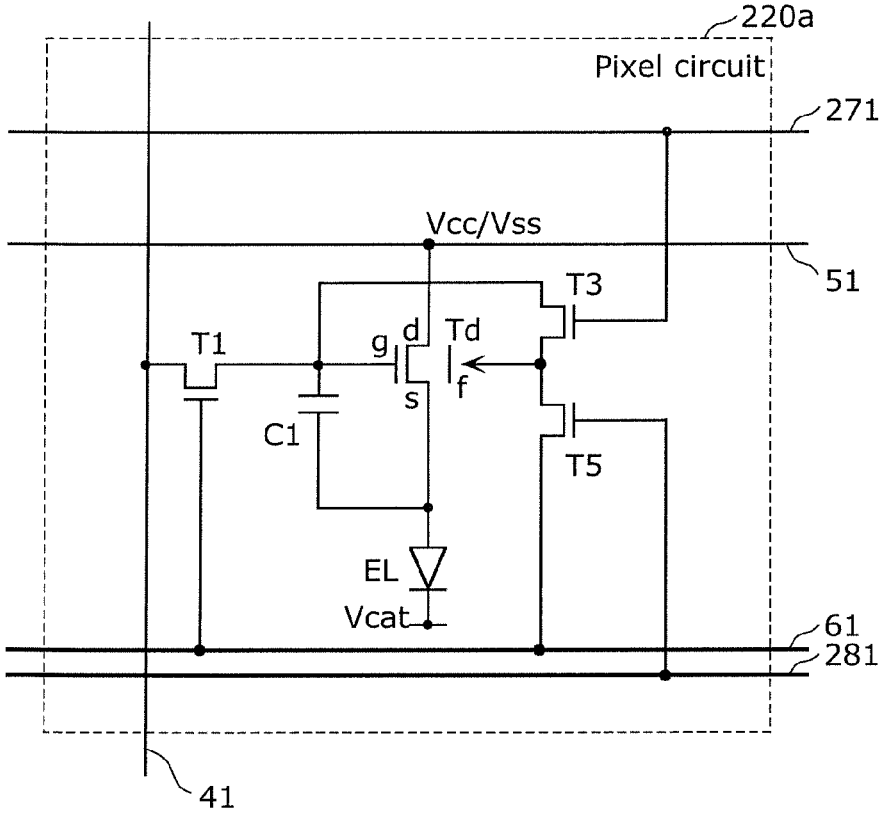
FIG. 30 illustrates a circuit diagram of the pixel circuit according to a variation of Embodiment 5.

Next, a pixel circuit according to a variation of the present embodiment will be described with reference to FIG. 30. FIG. 30 illustrates a circuit diagram of pixel circuit 220*a* according to the present variation.

As illustrated in FIG. 30, just like pixel circuit 220 according to the present embodiment, pixel circuit 220*a* includes organic EL element EL, storage capacitor C1, write transistor T1, driver transistor Td, N-channel transistor T3, and N-channel transistor T5.

Pixel circuit 220*a* according to the present variation differs from pixel circuit 220 according to the present embodiment in that the source electrode of N-channel transistor T5 is connected to scan line 61, and is the same in all other aspects.

As is the case with pixel circuit 220*a* according to the present variation, the source electrode of N-channel transistor T5 need not necessarily be connected to source electrode s of driver transistor Td. It is sufficient so long as a potential is applied to the source electrode of N-channel transistor T5 that is lower than a potential assumable by the source of driver transistor Td in the emission period of organic EL element EL. The potential of scan line 61 (approximately equal to 0V) is lower than the source potential of driver transistor Td (>0V) in the emission period. Accordingly, pixel circuit 220*a* according to the present variation has the same technical advantages as pixel circuit 220 according to the present embodiment.

Embodiment 6

Next, a pixel circuit and a display device according to Embodiment 6 will be described. The pixel circuit according to the present embodiment differs from the pixel circuit according to Embodiment 1 in that the P-channel transistor is used as a driver transistor. The following description of the pixel circuit and the display device according to the present embodiment will focus on the points of difference from pixel circuit 20 and display device 1 according to Embodiment 1.

6-1. Display Device Configuration

Figure 31:
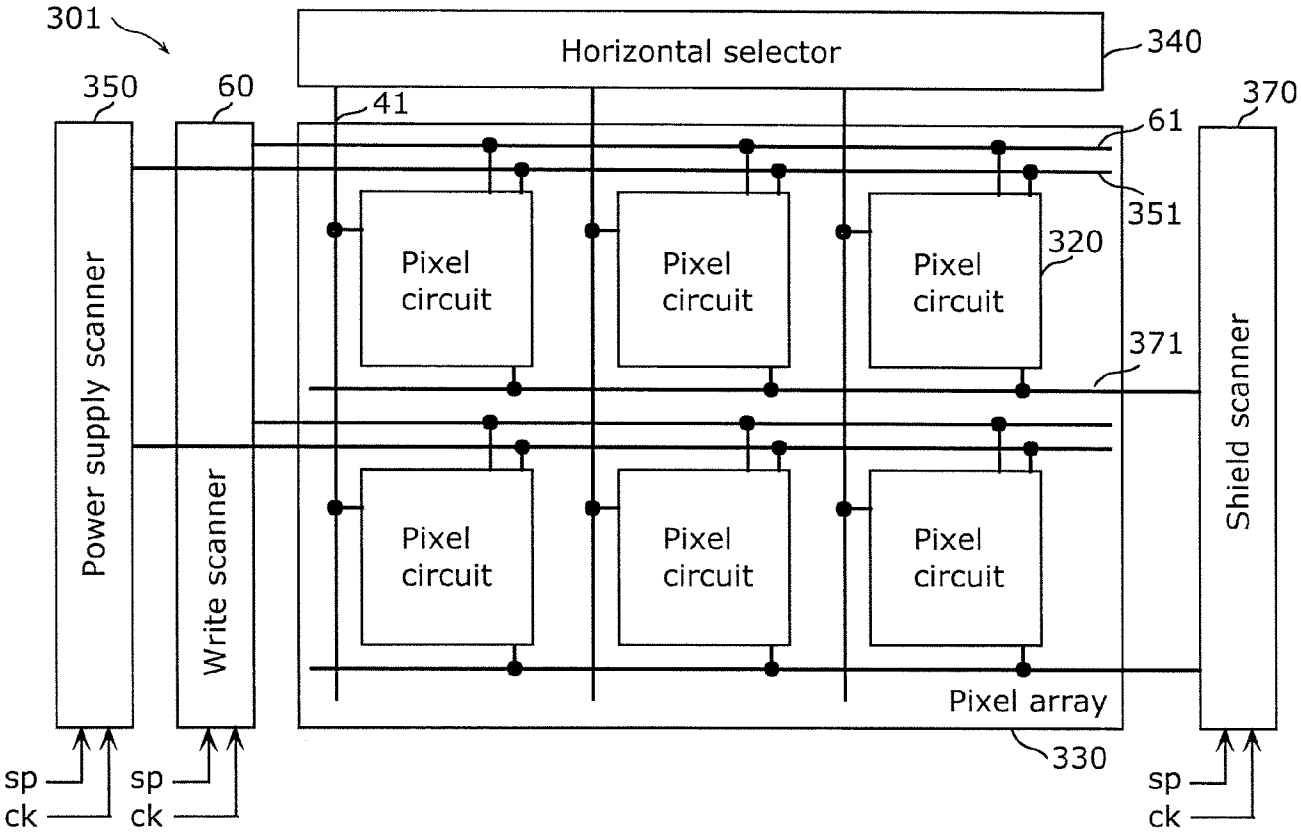
FIG. 31 illustrates a schematic configuration of the display device according to Embodiment 6.

First, the configuration of the display device according to the present embodiment will be described with reference to FIG. 31. FIG. 31 illustrates a schematic configuration of display device 301 according to the present embodiment.

As illustrated in FIG. 31, display device 301 includes pixel array 330, horizontal selector 340, power supply scanner 350, write scanner 60, and shield scanner 370. Pixel array 330 is comprised of pixel circuits 320 arranged in a two-dimensional matrix. Each pixel circuit 320 includes a light emitting element. Horizontal selector 340, power supply scanner 350, write scanner 60, and shield scanner 370 collectively form a drive circuit unit (drive unit) disposed in the vicinity of pixel array 330.

Each pixel row in pixel array 330 is provided with power supply line 351, scan line 61, and shield line 371 that extend parallel to the row direction (the direction in which pixel circuits 320 are arranged in a single pixel row) relative to the m rows and n columns of pixels. Furthermore, each pixel column is provided with signal line 341 that extends parallel to the column direction (the direction in which pixel circuits 320 are arranged in a single pixel column) relative to the m rows and n columns of pixels.

Figure 32:
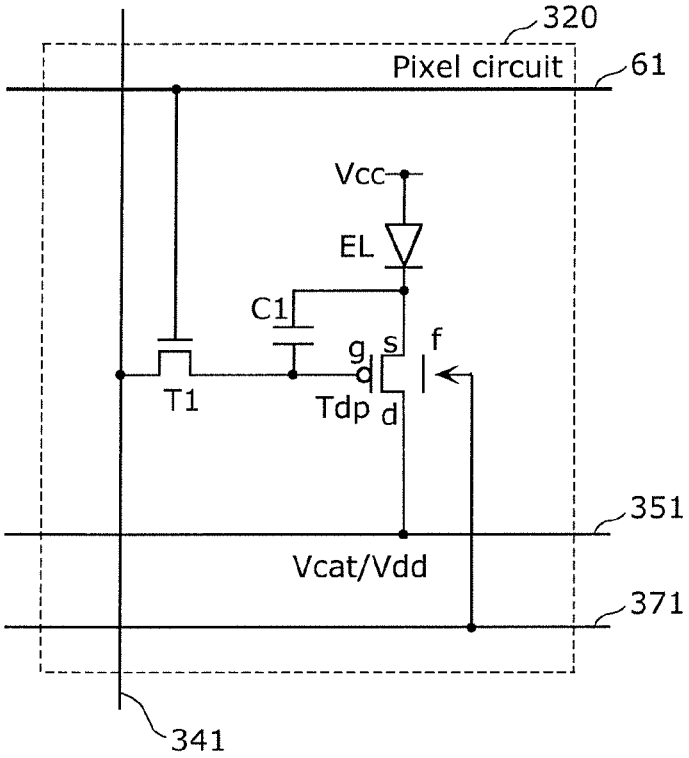
FIG. 32 illustrates a circuit diagram of the pixel circuit according to Embodiment 6.

Pixel circuit 320 is a pixel circuit that emits light based on an image signal. Hereinafter, pixel circuit 320 according to the present embodiment will be described with reference to FIG. 32. FIG. 32 illustrates a circuit diagram of pixel circuit 320 according to the present embodiment.

As illustrated in FIG. 32, pixel circuit 320 is a circuit that causes a light emitting element to emit light at a luminance that corresponds to the image signal, and includes organic EL element EL, storage capacitor C1, write transistor T1, and driver transistor Tdp. Pixel circuit 320 may further include, for example, a reference transistor and an initialization transistor. The reference transistor is a thin film transistor for applying a reference voltage to storage capacitor C1, and the initialization transistor is a thin film transistor for initializing the potential of a second electrode of organic EL element EL.

Organic EL element EL is one example of a light emitting element including a first electrode and a second electrode, just like organic EL element EL according to Embodiment 1. The first electrode and the second electrode are respectively the anode and the cathode of organic EL element EL. The first electrode of organic EL element EL is connected to an anode power supply line. The anode power supply line is supplied with first potential Vcc. In the present embodiment, anode potential Vcc is approximately 20V. The anode power supply line is wired commonly to all pixel circuits 320. The second electrode of organic EL element EL is connected to source electrode s of driver transistor Tdp and storage capacitor C1.

Storage capacitor C1 is an element for storing voltage, and is connected between gate electrode g and source electrode s of driver transistor Tdp.

Write transistor T1 is a thin film transistor for applying voltage that corresponds to the image signal to storage capacitor C1. Write transistor T1 is connected between signal line 341 to which the image signal is applied and gate electrode g of driver transistor Tdp. More specifically, signal line 341 is connected to one of the drain electrode and the source electrode of write transistor T1, and storage capacitor C1 and gate electrode g of driver transistor Tdp are connected to the other of the drain electrode and the source electrode of write transistor T1. Scan line 61 is connected to the gate electrode of write transistor T1. For example, write transistor T1 enters an ON state in accordance with an ON signal (i.e., a high potential signal), and stores voltage corresponding to the image signal in storage capacitor C1.

Driver transistor Tdp is a P-channel thin film transistor that is connected to the second electrode (cathode) of organic EL element EL and supplies current dependent on the voltage stored in storage capacitor C1 to organic EL element EL. Driver transistor Tdp includes gate electrode g, counter electrode f disposed opposite gate electrode g, and a channel disposed between gate electrode g and counter electrode f. Source electrode s of driver transistor Tdp is connected to the second electrode of organic EL element EL, and drain electrode d is connected to power supply line 351. Power supply line 351 is selectively supplied with cathode potential Vcat or third potential Vdd from power supply scanner 350. Counter electrode f also functions as a shield electrode that shields the channel. Either high-resistance potential Vh or low-resistance potential Vl is selectively applied to counter electrode f from shield scanner 370 via a shield line (potential application line) 371. Low-resistance potential Vl is a potential that, as a result of being applied to counter electrode f, reduces the resistance value of driver transistor Tdp to a lower value than when high-resistance potential Vh is applied to counter electrode f. When driver transistor Tdp is a P-channel thin film transistor, as is the case in the present embodiment, low-resistance potential Vl is lower than high-resistance potential Vh.

For example, an N-channel TFT can be used as write transistor T1, but the conductivity type of write transistor T1 is not limited to this example.

Moreover, depending on the relationship between the potential of the second electrode of organic EL element EL and the potential supplied from power supply line 351, the positional relationship of source electrode s and drain electrode d in driver transistor Tdp can be changed from the relationship illustrated in FIG. 32.

Horizontal selector 340 (signal line drive circuit) is a drive circuit that applies an image signal to signal line 341. Horizontal selector 340 selectively outputs signal voltage Vsig of the image signal and reference potential Vofs. Signal voltage Vsig is dependent on luminance information supplied from a signal supply source. Here, reference potential Vofs is a voltage that serves as a reference for signal voltage Vsig of an image signal (for example, a voltage corresponding to a black level of an image signal).

Signal voltage Vsig and reference potential Vofs output from horizontal selector 340 are written to pixel circuits 320 in pixel array 330 via signal line 341 on a row-by-row basis for pixel rows selected via scanning by write scanner 60. In other words, horizontal selector 340 employs a line sequential writing driving mode in which signal voltage Vsig is written on a row-by-row basis.

Power supply scanner 350 (power supply scan circuit) is configured of, for example, a shift register circuit that sequentially shifts start pulses sp in synchronization with clock pulse ck. Power supply scanner 350 switches between supplying cathode potential Vcat and supplying third potential Vdd, which is higher than cathode potential Vcat, to power supply line 351, in synchronization with the line sequential scanning by write scanner 60. As will be described later, this switching between cathode potential Vcat and third potential Vdd (switching between power supply potentials) controls the light emission and non-emission states of pixel circuits 320.

Write scanner 60 is a drive circuit that controls the write transistor included in pixel circuit 20 by applying a potential to scan line 61, and has the same configuration as write scanner 60 included in the above-described conventional display device 901.

Shield scanner 370 (potential application scan circuit) is configured of, for example, a shift register circuit that sequentially shifts (transfers) start pulses sp in synchronization with clock pulse ck. Shield scanner 370 applies low-resistance potential Vl to counter electrode f of driver transistor Tdp in a write period in which write transistor T1 conducts current in a state in which an image signal is applied to signal line 341 (i.e., in a mobility correction period). Shield scanner 370 applies high-resistance potential Vh to counter electrode f of driver transistor Tdp in an emission period of organic EL element EL. Shield scanner 370 sequentially applies high-resistance potential Vh and low-resistance potential Vl to each pixel circuit 320 in pixel array 330 on a row-by-row basis.

6-2. Circuit Operations

Figure 33:
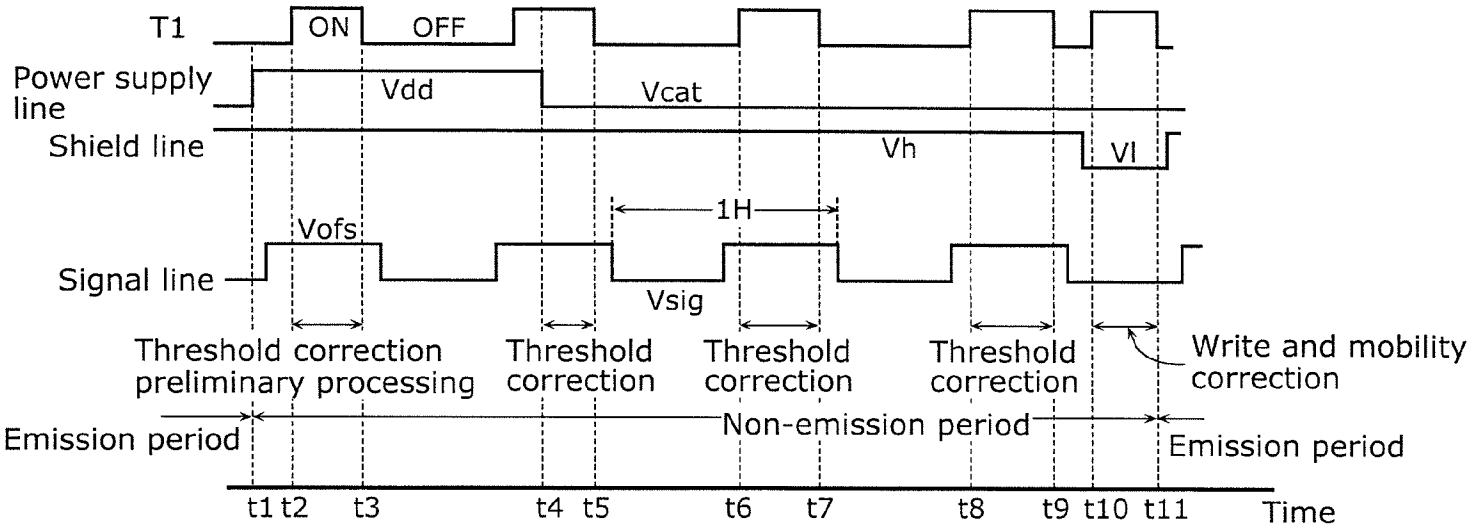
FIG. 33 is a timing chart for describing circuit operations performed by the display device according to Embodiment 6.

Next, circuit operations performed by display device 301 according to the present embodiment will be described with reference to FIG. 33. FIG. 33 is a timing chart for describing circuit operations performed by display device 301 according to the present embodiment. FIG. 33 illustrates changes in the potential of the gate electrode of write transistor T1 (i.e., the potential of scan line 61; either a high potential (ON) or low potential (OFF)), the potential (Vcat or Vdd) of power supply line 351, the potential (Vh or Vl) of shield line 371, and the potential (Vsig or Vofs) of signal line 341. In the present embodiment, potential Vcat is approximately 0V, potential Vdd is approximately 25V, high-resistance potential Vh is approximately 25V, low-resistance potential Vl is approximately 10V, and potential Vofs is approximately 20V.

Emission Period of Previous Display Frame

In the timing chart illustrated in FIG. 33, the period before time t1 is the emission period of organic EL element EL in the previous display frame. In the emission period of the previous display frame, the potential of power supply line 351 is cathode potential Vcat, and write transistor T1 is in a non-conducting state.

At this time, driver transistor Tdp is set so as to operate in the saturation region. Consequently, drive current (drain-source current) dependent on gate-source voltage Vgs of driver transistor Tdp is supplied from the anode power supply line to organic EL element EL. Accordingly, organic EL element EL emits light of a luminance that is in accordance with the current value of the drive current.

Non-Emission Period

At time t1, the line sequential scanning enters a new display frame (current display frame). Then, the potential of power supply line 351 switches from cathode potential Vcat to third potential Vdd. Relative to anode potential Vcc, third potential Vdd is a potential that is sufficiently high enough to cause organic EL element EL to not emit light.

Threshold Correction Preliminary Period

Next, the potential of scan line 61 transitioning from the low potential side to the high potential side (i.e., from OFF to ON) at time t2 places write transistor T1 in a conducting state.

At this time, since reference potential Vofs is supplied from horizontal selector 340 to signal line 341, gate potential Vg of driver transistor Tdp becomes reference potential Vofs. Moreover, source potential Vs of driver transistor Tdp is a potential that is sufficiently higher than reference potential Vofs, that is to say, is third potential Vdd.

At this time, gate-source voltage Vgs of driver transistor Tdp is Vofs−Vdd. Here, if Vofs−Vdd is not less than threshold voltage Vth of driver transistor Tdp, the threshold correction operation (to be described later) cannot be performed, so it is necessary to set Vofs−Vdd so as to satisfy the potential relation Vofs−Vdd<Vth (Expression 6).

In this way, initialization processing that fixes gate potential Vg of driver transistor Tdp to reference potential Vofs and fixes source potential Vs to third potential Vdd is preliminary processing performed before threshold correction operation (to be described later) (i.e., is threshold correction preliminary processing). Accordingly, reference potential Vofs and third potential Vdd are the initialization potentials of gate potential Vg and source potential Vs of driver transistor Tdp, respectively.

The potential of scan line 61 transitioning from the high potential side to the low potential side (i.e., from ON to OFF) at time t3 ends the threshold correction preliminary period. The period from time t2 to time t3 is a threshold correction preliminary period.

Threshold Correction Period

Next, at time t4, when the potential of power supply line 351 switches from third potential Vdd to cathode potential Vcat while write transistor T1 is in a conducting state, the second electrode of organic EL element EL becomes the source electrode s of driver transistor Tdp, and current flows to driver transistor Tdp. Consequently, the threshold correction operation starts in a state in which gate potential Vg of driver transistor Tdp is maintained at reference potential Vofs. In other words, source potential Vs of driver transistor Tdp begins to decrease from gate potential Vg toward a potential calculated by adding threshold voltage |Vth| of driver transistor Tdp (i.e., Vofs+|Vth|).

Here, for convenience, using reference potential Vofs (i.e., the initialization voltage) of gate potential Vg of driver transistor Tdp as a reference, the operation (process) for causing source potential Vs to change from reference potential Vofs toward a voltage calculated by adding threshold voltage |Vth| of driver transistor Tdp, will be referred to as a threshold correction operation (threshold correction processing). As this threshold correction operation progresses, in time, gate-source voltage Vgs of driver transistor Tdp converges to threshold voltage Vth of driver transistor Tdp. A voltage corresponding to this threshold voltage Vth is stored in storage capacitor C1.

Note that in the periods in which a threshold correction operation is performed, in order to cause current to flow to the storage capacitor C1 side and not to flow to the organic EL element EL side, anode potential Vcc of the anode power supply line is set so as to place organic EL element EL in a cut-off state (high-impedance state).

Next, at time t5, the potential of scan line 61 transitioning to the low potential side (i.e., from ON to OFF) places write transistor T1 in a non-conducting state. Write transistor T1 enters a non-conducting state at time t5, which is a point in time after elapse of a first period after time t4. At this time, gate electrode g of driver transistor Tdp is in a floating state as a result of electrically disconnecting from signal line 341. However, since gate-source voltage Vgs is less than threshold voltage Vth of driver transistor Tdp, current (drain current Ids) flows, and the gate and source potentials of driver transistor Tdp decrease.

Next, at time t6, in the period in which the potential of signal line 341 is reference potential Vofs (for example, at the point in time the potential of signal line 341 becomes reference potential Vofs), write transistor T1 is placed in a conducting state, and threshold correction operation is started once again. By repeating this operation, the value of gate-source voltage Vgs of driver transistor Tdp eventually becomes threshold voltage Vth.

Next, at time t7, the potential of scan line 61 transitioning to the low potential side (i.e., from ON to OFF) places write transistor T1 in a non-conducting state. Write transistor T1 enters a non-conducting state at time t7, which is a point in time after elapse of a second period after time t6.

Moreover, the threshold correction operation is repeated in the period between time t8 and time t9 as well. Time t9 is the time at which the threshold correction operation ends, and write transistor T1 enters a non-conducting state at time t9. The period from time t4 to time t5, the period from time t6 to time t7, and the period from time t8 to time t9 are threshold correction periods.

In this way, in addition to the 1H period in which display device 301 performs the threshold correction operation along with the write operation and the mobility correction operation, display device 901 may perform the threshold correction operation multiple times divided across a plurality of horizontal periods ahead of the 1H period, that is to say, perform a "divided threshold correction operation".

With this divided threshold correction operation, even if the time allotted as a single horizontal period is short due to an increase in the number of pixels to achieve a higher definition, sufficient time can be ensured across a plurality of horizontal periods functioning as the threshold correction period. Accordingly, since a sufficient amount of time for a threshold correction period can be ensured even if the time allotted to a single horizontal period is short, it is possible to perform the threshold correction operation with certainty. Note that the number of times the threshold correction operation is performed is not limited to the above example; for example, the threshold correction operation may be performed only one time.

Write and Mobility Correction Period

Next, at time t10, in a state in which the potential of signal line 341 has switched from reference potential Vofs to signal voltage Vsig of the image signal, the potential of scan line 61 transitioning to the high potential side (i.e., from OFF to ON) places write transistor T1 in a conducting state, whereby signal voltage Vsig of the image signal is sampled and written in pixel circuit 320. Moreover, signal voltage Vsig is a voltage dependent on the gradation of the image signal, and is lower than reference potential Vofs.

The writing of signal voltage Vsig by write transistor T1 turns gate potential Vg of driver transistor Tdp into signal voltage Vsig. At this time, organic EL element EL is in a cut-off state. Accordingly, depending on signal voltage Vsig of the image signal, the current flowing through driver transistor Tdp (drain-source current Ids) from power supply line 351 flows out of storage capacitor C1 and equivalent capacitor Cel of organic EL element EL. This starts the discharging of storage capacitor C1 and equivalent capacitor Cel.

The discharging of equivalent capacitor Cel of organic EL element EL causes source potential Vs of driver transistor Tdp to decrease over time. At this time, variations in threshold voltage Vth of driver transistor Tdp between pixel circuits 320 are already cancelled by the threshold correction operation, and drain-source current Ids of driver transistor Tdp is dependent on mobility μ of driver transistor Tdp. With this, reflecting mobility μ, the value of gate-source voltage Vgs of driver transistor Tdp decreases, and after elapse of a given period of time, becomes a value that completely corrects mobility μ. Note that mobility μ of driver transistor Tdp is the mobility of the semiconductor thin film that forms the channel of driver transistor Tdp.

In the present embodiment, in the write period in which write transistor T1 conducts current in a state in which an image signal is applied to signal line 341 (i.e., in the period from time t10 to time t11), low-resistance potential Vl is applied to counter electrode f of driver transistor Tdp, and in the emission period of organic EL element EL, high-resistance potential Vh is applied to counter electrode f. With this, in the write and mobility correction period, since the resistance value of driver transistor Tdp decreases, the drain-source current that flows through driver transistor Tdp can be increased. Accordingly, source potential Vs can be decreased in a shorter period of time. Stated differently, mobility correction can be sped up.

Note that with pixel circuit 320 according to the present embodiment, since the resistance value of driver transistor Tdp only decreases in the write and mobility correction period, it is possible to inhibit the influence of noise on driver transistor Tdp in other periods.

Emission Period

Next, at time t11, the potential of scan line 61 transitioning to the low potential side (i.e., from ON to OFF) places write transistor T1 in a non-conducting state, and the write operation ends. Consequently, gate electrode g of driver transistor Tdp is in a floating state as a result of electrically disconnecting from signal line 341. The period from time t10 to time t11 is a write and mobility correction period.

Here, when gate electrode g of driver transistor Tdp is in a floating state, by storage capacitor C1 being connected between the gate and source of driver transistor Tdp, gate potential Vg changes in conjunction with changes in source potential Vs of driver transistor Tdp. In other words, source potential Vs and gate potential Vg of driver transistor Tdp decrease while gate-source voltage Vgs stored in storage capacitor C1 is maintained. Source potential Vs of driver transistor Tdp decreases to a light-emission voltage of organic EL element EL that is dependent on drain-source current Ids (saturation current) of driver transistor Tdp.

As described above, display device 301 that includes pixel circuit 320 using a P-channel transistor as the driver transistor Tdp has the same technical advantages as display device 1 that includes pixel circuit 20 using an N-channel transistor as driver transistor Td.

Embodiment 7

Next, a pixel circuit and a display device according to Embodiment 7 will be described. The display device according to the present embodiment mainly differs from pixel circuit 320 and display device 301 according to Embodiment 6 in that transistors for switching applied potentials are connected to counter electrode f of driver transistor Tdp. The following description of the pixel circuit and the display device according to the present embodiment will focus on the points of difference from pixel circuit 320 and display device 301 according to Embodiment 6.

7-1. Display Device Configuration

Figure 34:
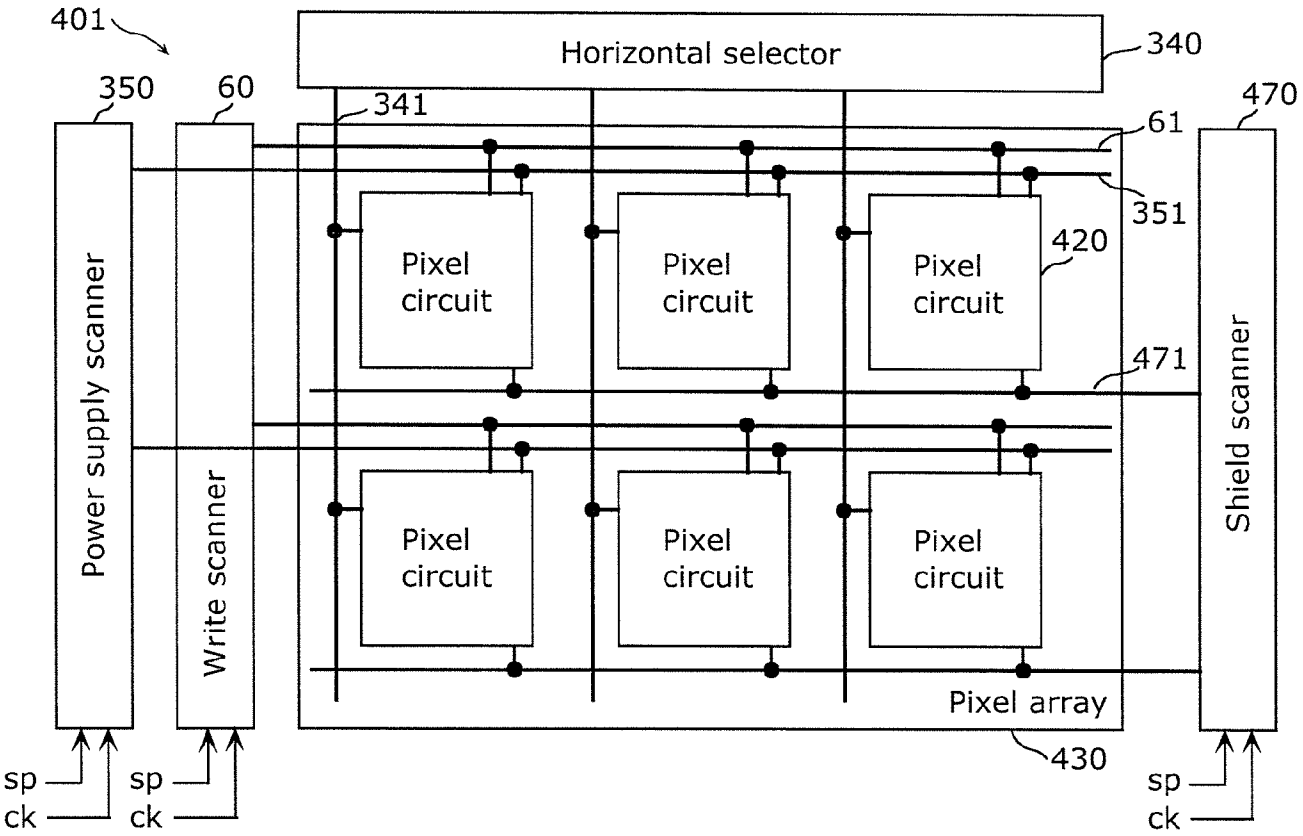
FIG. 34 illustrates a schematic configuration of the display device according to Embodiment 7.

First, the configuration of the display device according to the present embodiment will be described with reference to FIG. 34. FIG. 34 illustrates a schematic configuration of display device 401 according to the present embodiment.

As illustrated in FIG. 34, display device 401 includes pixel array 430, horizontal selector 340, power supply scanner 350, write scanner 60, and shield scanner 470. Pixel array 430 is comprised of pixel circuits 420 arranged in a two-dimensional matrix. Each pixel circuit 420 includes a light emitting element. Horizontal selector 340, power supply scanner 350, and write scanner 60 have the same configurations as horizontal selector 340, power supply scanner 350, and write scanner 60 according to Embodiment 6, respectively.

Shield scanner 470 (potential application scan circuit) according to the present embodiment is configured of, for example, a shift register circuit that sequentially shifts (transfers) start pulses sp in synchronization with clock pulse ck. Shield scanner 470 applies a high level potential to shield line 471 in a write period in which write transistor T1 conducts current in a state in which an image signal is applied to signal line 341 (i.e., in a mobility correction period). Shield scanner 470 applies a low level potential to shield line 471 in the emission period of organic EL element EL. Shield scanner 470 sequentially applies a high level or low level potential to each pixel circuit 420 in pixel array 430 on a row-by-row basis.

Each pixel row in pixel array 430 is provided with power supply line 351, scan line 61, and shield line 471 that extend parallel to the row direction (the direction in which pixel circuits 420 are arranged in a single pixel row) relative to the m rows and n columns of pixels. Furthermore, each pixel column is provided with signal line 341 that extends parallel to the column direction (the direction in which pixel circuits 420 are arranged in a single pixel column) relative to the m rows and n columns of pixels.

Figure 35:
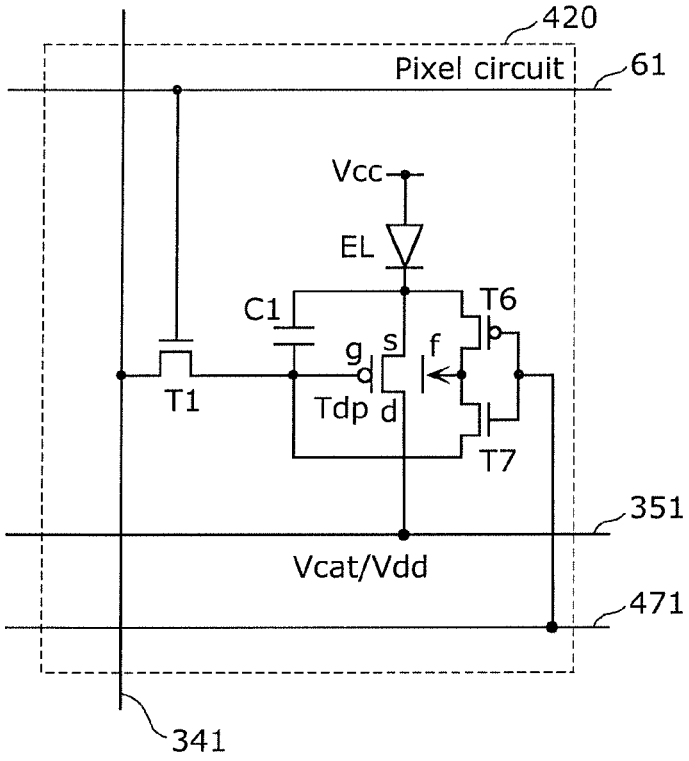
FIG. 35 illustrates a circuit diagram of the pixel circuit according to Embodiment 7.

Pixel circuit 420 is a pixel circuit that emits light based on an image signal. Hereinafter, pixel circuit 420 according to the present embodiment will be described with reference to FIG. 35. FIG. 35 illustrates a circuit diagram of pixel circuit 420 according to the present embodiment.

As illustrated in FIG. 35, just like pixel circuit 320 according to Embodiment 6, pixel circuit 420 includes organic EL element EL, storage capacitor C1, write transistor T1, and driver transistor Tdp. In the present embodiment, pixel circuit 420 further includes a pair of switching transistors connected to counter electrode f. In the present embodiment, the pair of switching transistors includes P-channel transistor T6 and N-channel transistor T7 that share a gate.

The source electrode of P-channel transistor T6 is connected to source electrode s of driver transistor Tdp, the drain electrode of P-channel transistor T6 is connected to counter electrode f of driver transistor Tdp, and the gate electrode of P-channel transistor T6 is connected to shield line 471.

The source electrode of N-channel transistor T7 is connected to gate electrode g of driver transistor Tdp, the drain electrode of N-channel transistor T6 is connected to counter electrode f of driver transistor Tdp, and the gate electrode of N-channel transistor T6 is connected to shield line 471.

7-2. Circuit Operations

Figure 36:
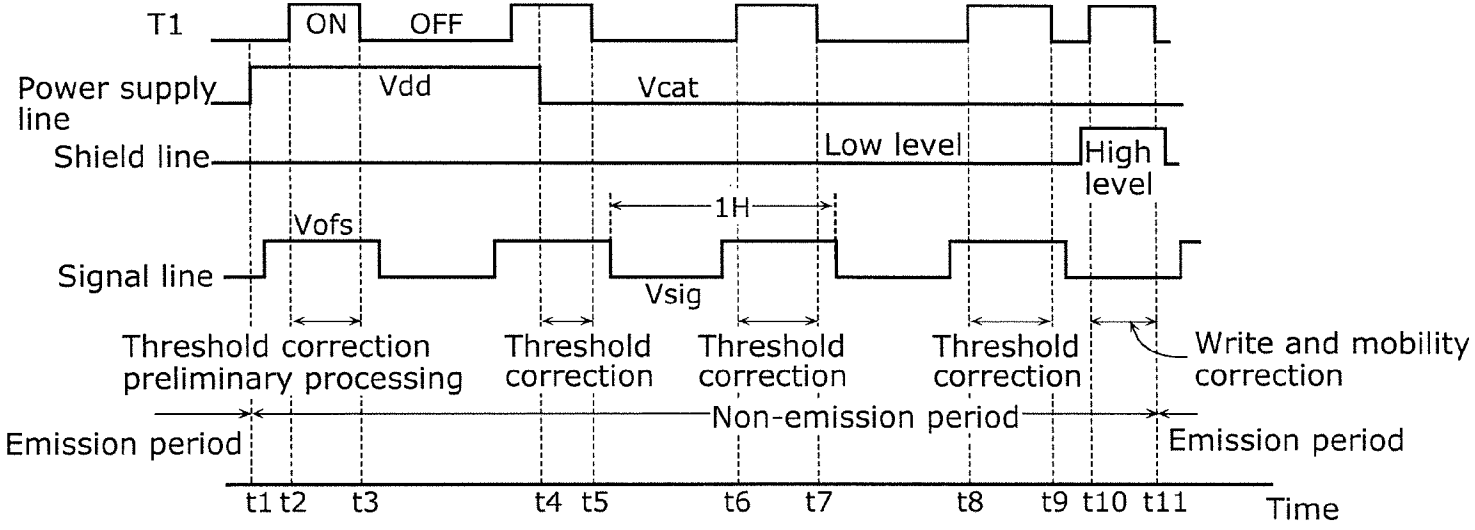
FIG. 36 is a timing chart for describing circuit operations performed by the display device according to Embodiment 7.

Next, circuit operations performed by display device 401 according to the present embodiment will be described with reference to FIG. 36. FIG. 36 is a timing chart for describing circuit operations performed by display device 401 according to the present embodiment. Similar to FIG. 33, FIG. 36 illustrates changes in the potential of the gate electrode of write transistor T1, the potential of power supply line 351, the potential of shield line 471, and the potential of signal line 341.

According to the present embodiment, the potential of the gate electrode of write transistor T1, the potential of power supply line 351, and the potential of signal line 341 change in the same manner as shown in the timing chart illustrated in FIG. 33. Moreover, the voltage applied from shield scanner 470 to shield line 471 is a low level potential up until immediately before time t10, and is a high level potential from time t10 up until immediately after time t11. Here, the high level potential is a potential that is sufficiently high enough to, when applied to the gate electrode of P-channel transistor T6 and N-channel transistor T7, place P-channel transistor T6 in a non-conducting state and N-channel transistor T7 in a conducting state. The low level potential is a potential that is sufficiently low enough to, when applied to the gate electrode of P-channel transistor T6 and N-channel transistor T7, place P-channel transistor T6 in a conducting state and N-channel transistor T7 in a non-conducting state.

Accordingly, in the present embodiment, in the period from time t10 to time t11, P-channel transistor T6 is in a non-conducting state and N-channel transistor T7 is in a conducting state. Accordingly, a potential equal to the potential at gate electrode g is applied to counter electrode f of driver transistor Tdp. On the other hand, in other periods, P-channel transistor T6 is in a conducting state and N-channel transistor T7 is in a non-conducting state. Accordingly, a potential equal to the potential at source electrode s is applied to counter electrode f of driver transistor Tdp. Since the gate potential of driver transistor Tdp is lower than the source potential, just like in Embodiment 6, the potential applied to counter electrode fin the write period reduces the resistance value of driver transistor Tdp to a lower value than the potential applied to counter electrode fin the emission period does in the present embodiment as well. Accordingly, pixel circuit 420 according to the present embodiment has the same technical advantages as Embodiment 6.

Furthermore, in the present embodiment, since the gate potential of driver transistor Tdp is applied as a low-resistance potential, current corresponding to signal voltage Vsig flows in mobility correction. Accordingly, since driver transistor Tdp assumes a value corresponding to signal voltage Vsig, it is possible to inhibit mobility over-correction when signal voltage Vsig is low.

7-3. Variation

In pixel circuit 420 according to the present embodiment, P-channel transistor T6 is connected between source electrode s and counter electrode f of driver transistor Tdp, and N-channel transistor T7 is connected between gate electrode g and counter electrode f of driver transistor Tdp. However, the circuit configuration of pixel circuit 420 according to the present embodiment is not limited to this example. For example, in pixel circuit 420, the N-channel transistor may be connected between source electrode s and counter electrode f of driver transistor Tdp, and the P-channel transistor may be connected between gate electrode g and counter electrode f of driver transistor Tdp. In other words, in pixel circuit 420, the locations at which N-channel transistor T6 and P-channel transistor T7 are connected may be swapped. In such cases, if the potential applied from shield scanner 470 to shield line 471 is reversed, that is to say, if a high level potential is applied to shield line 471 up until immediately before time t10 and a low level signal is applied to shield line 471 from time t10 to time t11, the result is a pixel circuit that operates in the same manner as pixel circuit 420.

Moreover, in display device 401 according to the present embodiment, instead of a configuration that uses shield scanner 470, scan line 61 may be connected to the gate electrode of P-channel transistor T6 and N-channel transistor T7. With this, a high potential is applied to the gate electrode of P-channel transistor T6 and N-channel transistor T7 in the write and mobility correction period, and a low potential is applied in the emission period. In other words, in the present variation as well, the potential applied to counter electrode f in the write and mobility correction period can reduce the resistance value of driver transistor Td to a lower value than the potential applied to counter electrode f in the emission period can.

OTHER EMBODIMENTS

Hereinbefore, the pixel circuit, etc., according to the present disclosure has been described based on, but is not limited to, various exemplary embodiments. Embodiments resulting from arbitrary combinations of elements of the different exemplary embodiments, embodiments resulting from various modifications of the exemplary embodiments that may be conceived by those skilled in the art without materially departing from the novel teachings and advantages of the present disclosure, and various devices that include the pixel circuit, etc., according to the above exemplary embodiments are intended to be included within the scope of the present disclosure.

For example, in the above exemplary embodiments, low-resistance potential Vl is applied from a predetermined time before the write and mobility correction period and until a predetermined time after the write and mobility correction period, but the application period of low-resistance potential Vl is not limited to this example. It is sufficient so long as low-resistance potential Vl is applied in at least part of the mobility correction period. For example, low-resistance potential Vl may be applied across the mobility correction period, and may be applied in some other period. Moreover, high-resistance potential Vh may be applied in part of the emission period of organic EL element EL.

Moreover, in the above exemplary embodiments, the mobility correction is sped up in all pixel circuits included in the pixel array, but the mobility correction may be sped up in only some of the pixel circuits. For example, the mobility correction may be sped up in only those pixel circuits that emit blue light. The capacitance component of organic EL elements that emit blue light is typically large due to the film thickness of the light emitting layer being thinner than the light emitting layers in organic EL elements that emit green light or red light. Accordingly, a configuration in which mobility correction is sped up only in pixel circuits that include organic EL elements that emit blue light, and not sped up in other pixel circuits is acceptable. For example, a pixel circuit according to any one of the above exemplary embodiments may be applied to only those pixel circuits that include organic EL elements that emit blue light, and the conventional pixel circuit 920 may be applied to the remaining pixel circuits. Stated differently, a pixel circuit according to any one of the above exemplary embodiments may be applied to only those pixel circuits that include organic EL elements that emit blue light, and in the remaining pixel circuits, the driver transistor need not include a counter electrode. This reduces the time required to perform mobile correction in the pixel circuits.

Moreover, in each of the above exemplary embodiments, the light emitting element included in the pixel circuit is exemplified as an organic EL element, but the light emitting element is not limited to an organic EL element. The light emitting element may be, for example, a quantum-dot light emitting diode (QLED). A QLED may include a light emitter that emits light, and the light emitter may include quantum dots. Moreover, a QLED may include a light emitter that emits light, a wavelength converter that converts the wavelength of light emitted by the light emitter, and the wavelength converter may include quantum dots.

INDUSTRIAL APPLICABILITY

The present disclosure is useful in organic EL flat panel displays, and is particularly optimal for use in large screen displays.

The invention claimed is:

1. A pixel circuit configured to emit light based on an image signal, the pixel circuit comprising:

a light emitting element;

a driver transistor configured to adjust current supplied to the light emitting element; and a write transistor connected between a signal line to which the image signal is applied and the driver transistor, wherein the driver transistor includes:

a gate electrode;

a counter electrode disposed opposite the gate electrode; and a channel disposed between the gate electrode and the counter electrode, and a potential applied to the counter electrode in a write period in which the write transistor conducts current in a state in which the image signal is applied to the signal line reduces a resistance value of the driver transistor to a lower value than a potential applied to the counter electrode in an emission period of the light emitting element does, wherein the pixel circuit further comprises a pair of switching transistors connected to the counter electrode;

wherein the potential applied to the counter electrode is selected according to ON and OFF states of the pair of switching transistors, and wherein the pair of switching transistors includes an N-channel transistor and a P-channel transistor that share a gate.

2. The pixel circuit according to claim 1, wherein a gate potential of the N-channel transistor and the P-channel transistor is equal to a gate potential of the write transistor.

* * * * *